US008235779B2

(12) United States Patent
Yoshizawa

(10) Patent No.: US 8,235,779 B2
(45) **Date of Patent: *Aug. 7, 2012**

(54) GAMING MACHINE DETERMINING PAYOUT SYMBOL IN SECOND GAME REQUIRING MORE PLAYER'S INVOLVEMENT

(75) Inventor: Kazumasa Yoshizawa, Tokyo (JP)

(73) Assignee: Universal Entertainment Corporation, Tokyo (JP)

( * ) Notice: Subject to any disclaimer, the term of this patent is extended or adjusted under 35 U.S.C. 154(b) by 562 days.

This patent is subject to a terminal disclaimer.

(21) Appl. No.: 12/390,900

(22) Filed: Feb. 23, 2009

(65) Prior Publication Data

US 2009/0227347 A1 Sep. 10, 2009

Related U.S. Application Data

(60) Provisional application No. 61/035,122, filed on Mar. 10, 2008.

(51) Int. Cl.
*A63F 9/24* (2006.01)

(52) U.S. Cl. ..... 463/10; 463/16; 463/17; 463/21

(58) Field of Classification Search ..... 463/10, 463/15–21, 30, 31
See application file for complete search history.

(56) References Cited

U.S. PATENT DOCUMENTS

| | | | | |
|---|---|---|---|---|
| 6,093,102 | A | 7/2000 | Bennett | |
| 6,168,523 | B1 | 1/2001 | Piechowiak et al. | |
| 6,960,133 | B1 | 11/2005 | Marks et al. | |
| 2009/0143131 | A1 * | 6/2009 | Yoshizawa | 463/20 |

* cited by examiner

*Primary Examiner* — Hsien Ming Lee
(74) *Attorney, Agent, or Firm* — Edwards Wildman Palmer LLP

(57) ABSTRACT

The present invention provides a gaming machine which: displays a moving symbol on a main display in a case where a plurality of specific symbols are displayed; displays a plurality of score symbols associated with scores on a second display from a first side edge to a second side edge of the second display; displays the moving symbol in a direction that intersects with a moving direction of the score symbols displayed on the second display in response to each input from an input device; and, in a case where the moving symbol is determined to superimpose any one of the plurality of score symbols, provides an award corresponding to a score of the score symbol being superimposed.

7 Claims, 16 Drawing Sheets

FIG. 5
SYMBOL DATA TABLE
| SYMBOL DATA | STANDARD PAYOUT AMOUNT | FULL CONSECUTIVE SYMBOLS PAYOUT AMOUNT | PROBABILITY OF APPEARANCE | ATTRIBUTE VALUE |
|---|---|---|---|---|
| 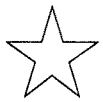 | 100 | 1000 | 0～19017<br>19018/65536 | A |
| 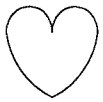 | 100 | 1000 | 19018～38035<br>19018/65536 | B |
| 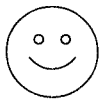 | 200 | 2000 | 38036～48035<br>10000/65536 | C |
| 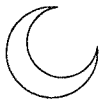 | 200 | 2000 | 48036～58035<br>10000/65536 | D |
| 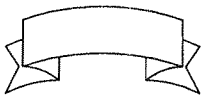 | 400 | 4000 | 58036～63035<br>5000/65536 | E |
| 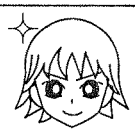 | 800 | 8000 | 63036～65535<br>2500/65536 | F<br>(SCATTER) |

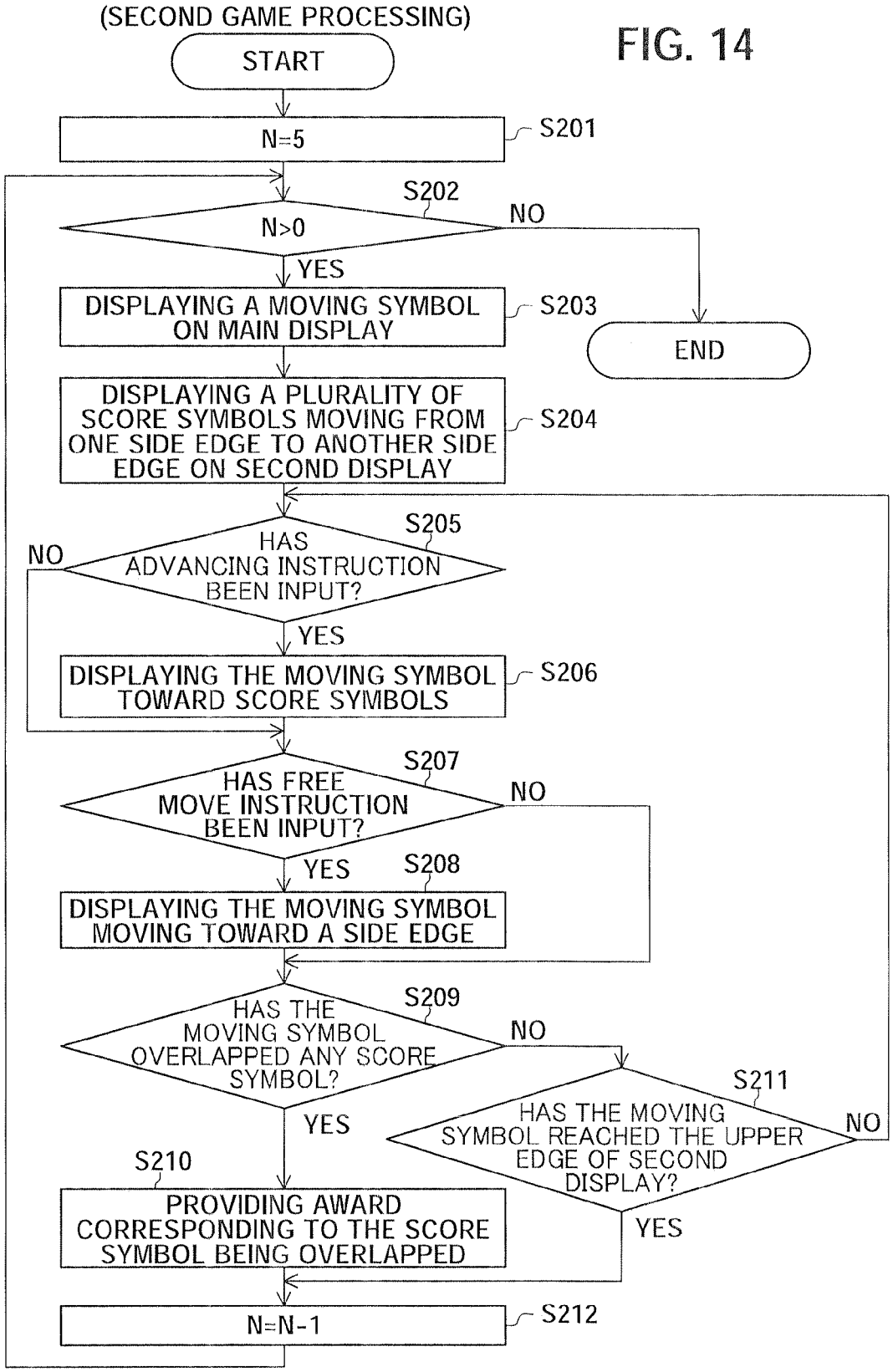
(SECOND GAME PROCESSING)
FIG. 14
START
N=5
S201
S202
N>0
NO
YES
DISPLAYING A MOVING SYMBOL ON MAIN DISPLAY
S203
END
DISPLAYING A PLURALITY OF SCORE SYMBOLS MOVING FROM ONE SIDE EDGE TO ANOTHER SIDE EDGE ON SECOND DISPLAY
S204
S205
HAS ADVANCING INSTRUCTION BEEN INPUT?
NO
YES
DISPLAYING THE MOVING SYMBOL TOWARD SCORE SYMBOLS
S206
S207
HAS FREE MOVE INSTRUCTION BEEN INPUT?
NO
YES
S208
DISPLAYING THE MOVING SYMBOL MOVING TOWARD A SIDE EDGE
S209
HAS THE MOVING SYMBOL OVERLAPPED ANY SCORE SYMBOL?
NO
YES
S211
HAS THE MOVING SYMBOL REACHED THE UPPER EDGE OF SECOND DISPLAY?
NO
YES
S210
PROVIDING AWARD CORRESPONDING TO THE SCORE SYMBOL BEING OVERLAPPED
N=N-1
S212

GAMING MACHINE DETERMINING PAYOUT SYMBOL IN SECOND GAME REQUIRING MORE PLAYER'S INVOLVEMENT

CROSS REFERENCE TO RELATED APPLICATIONS

This application claims benefit of U.S. Provisional Application No. 61/035,122, filed Mar. 10, 2008, the entire contents of which are incorporated herein by reference.

BACKGROUND OF THE INVENTION

1. Field of the Invention

The present invention relates to a gaming machine; more specifically, to a gaming machine determining a payout symbol in a second game.

2. Related Art

Conventionally, slot machines that provide a gaming medium in accordance with a combination of symbols displayed generally have straight winning lines (active pay lines) for paying out the gaming medium. However, slot machines having various winning lines (active pay lines) and slot machines having no winning lines (active pay lines) have also been introduced. As an example, U.S. Pat. Nos. 6,093,102 and 6,960,133 disclose slot machines having winning lines (active pay lines) that are not straight. In such slot machines providing a payout using various winning lines (active pay lines) and slot machines providing a payout in a case where a predetermined number of symbols are displayed on a matrix display region, display contents may be complicated and difficult to be visually recognized by players. In addition, such slot machines may provide display contents similar to that of a conventional slot machine having straight winning lines (active pay lines), while providing wide variety of games. Furthermore, players may find the game too simple, in which the symbols start moving with only one push operation on a start button and automatically stop moving.

Slot machines executing a second game in response to a predetermined condition being met in a basic game to attract the interest of a player are known, where the second game is different from a routine unit game in which symbols are rearranged after making a bet and operating a spin button. The second game is executed in a case where a predetermined symbol is displayed in the basic game, and generally provides a greater amount of payout than that of the basic game. In addition, the second game generally does not consider the course of the basic game, and determines, independently from the basic game, whether a payout is provided or not. For example, U.S. Pat. No. 6,168,523 discloses that, a bonus feature game is executed in a case where predetermined bonus symbols have been displayed in a normal mode. Since a rate of the cash and medals paid for an award can be varied by providing such a bonus game in addition to a basic game, the effects of the increased attractiveness is expected to be provided compared to a slot machine that only performs a basic game.

The present invention has been made in view of the above-mentioned problems, and an objective thereof is to provide a gaming machine: providing symbols to be displayed with a variety of effects, to differentiate from other models; providing more operations involving the player and making the player's intention to be reflected on the symbols used in the game, thereby motivating the player.

Another objective of the present invention is to provide a gaming machine with improved entertainment properties by providing attractive effects in a second game with a higher payout rate than that of a so-called basic game.

SUMMARY OF THE INVENTION

In a first aspect of the present invention, a gaming machine includes: a first display and a rectangular second display for displaying images; an input device for accepting an input from a player; and a controller for executing processing of: (a) determining whether a plurality of specific symbols are displayed on the first display in a specific pattern in a basic game or not; (b) starting execution of a second game in a case where the plurality of specific symbols are determined to be displayed in the specific pattern; (c) in the second game, displaying a moving symbol on the first display; (d) displaying a plurality of score symbols moving from a first side edge to a second side edge of the second display, where the score symbols are associated with obtained scores and the first and second side edges are facing each other; (e) upon accepting each input from the input device, displaying the moving symbol moving a predetermined distance in a direction intersectional to a moving direction of the score symbols displayed on the second display; (I) determining whether the moving symbol superimposes any one of the plurality of score symbols or not; and (g) in a case where the moving symbol is determined to superimpose any one of the plurality of score symbols, providing an award corresponding to a score of the score symbol being superimposed.

The gaming machine of the first aspect executes processing of: (a) determining whether a plurality of specific symbols are displayed on the first display in a specific pattern in a basic game or not; (b) starting execution of a second game in a case where the plurality of specific symbols are determined to be displayed in the specific pattern; (c) in the second game, displaying a moving symbol on the first display; (d) displaying a plurality of score symbols moving from a first side edge to a second side edge of the second display, where the score symbols are associated with obtained scores and the two side edges are facing each other; (e) upon accepting each input from the input device, displaying the moving symbol moving a predetermined distance in a direction intersectional to the moving direction of the score symbols displayed on the second display; (f) determining whether the moving symbol superimposes any one of the plurality of score symbols or not; and (g) in a case where the moving symbol is determined to superimpose any one of the plurality of score symbols, providing an award corresponding to a score of the score symbol being superimposed, thereby providing an improved entertainment properties by providing attractive effects in a second game with a higher payout rate than that of a so-called basic game. In addition, the moving symbol requires a repetitive operation of the input device by the player to reach any one of the score symbols; thus providing more opportunities for the player to be involved in the game and an improved entertainment property.

According to a second aspect of the present invention, in the gaming machine according to the first aspect, in the second game, the controller displays the moving symbol upon accepting each input from the input device, the moving symbol running through the first display and moving over to the second display in a direction intersectional to the moving direction of the score symbols displayed on the second display.

According to the second aspect of the present invention, the gaming machine as described in the first aspect is provided, in which, in the second game, the controller displays the moving symbol upon accepting each input from the input device, the moving symbol running through the first display and moving over to the second display in the direction intersectional to the moving direction of the score symbols displayed on the second display. The moving symbol requires a repetitive operation of the input device by the player to reach any one of the score symbols; thus providing more opportunities for the player to be involved in the game and an improved entertainment property.

According to a third aspect of the present invention, in the gaming machine according to the first aspect is provided, in which, in the processing (b), the controller starts executing the second game in a case in which at least a predetermined number of the specific symbols are displayed on the first display. In a fourth aspect of the present invention, a gaming machine is provided in which a second display is disposed above the first display.

In a fifth aspect of the present invention, a gaming machine includes: a first display and a rectangular second display for displaying images; an input device for accepting an input from a player; and a controller for executing processing of: (a) determining whether a plurality of specific symbols are displayed on the first display in a specific pattern in a basic game or not; (b) starting execution of a second game in a case where at least a predetermined number of the specific symbols are determined to be displayed on the first display; (c) in the second game, displaying a moving symbol on the first display; (d) displaying a plurality of score symbols moving from a first side edge to a second side edge of the second display, where the score symbols are associated with obtained scores and the two side edges are facing each other; (e) upon accepting each input from the input device, displaying the moving symbol moving a predetermined distance in a direction intersectional to a moving direction of the score symbols displayed on the second display; (f) determining whether the moving symbol superimposes any one of the plurality of score symbols or not; and (g) in a case where the moving symbol is determined to superimpose any one of the plurality of score symbols, providing an award corresponding to a score of the score symbol being superimposed.

The gaming machine of the fifth aspect is adapted to (a) determining whether a plurality of specific symbols are displayed on the first display in a specific pattern in a basic game or not; (b) starting execution of a second game in a case where at least a predetermined number of the specific symbols are determined to be displayed on the first display; (c) in the second game, displaying a moving symbol on the first display; (d) displaying a plurality of score symbols moving from a first side edge to a second side edge of the second display, where the score symbols are associated with obtained scores and the two side edges are facing each other; (e) upon accepting each input from the input device displaying the moving symbol moving a predetermined distance in a direction intersectional to the moving direction of the score symbols displayed on the second display; (If) determining whether the moving symbol superimposes any one of the plurality of score symbols or not; and (g) in a case where the moving symbol is determined to superimpose any one of the plurality of score symbols, providing an award corresponding to a score of the score symbol being superimposed, thus providing improved entertainment property by providing attractive effects in a second game with a higher payout rate than that of a so-called basic game. In addition, the moving symbol requires a repetitive operation of the input device by the player to reach any one of the score symbols; thus providing more opportunities for the player to be involved in the game and an improved entertainment property.

In a sixth aspect of the present invention, a gaming machine is provided including: a first display and a rectangular second display for displaying images; an input device for accepting an input from a player; and a controller for executing processing of: (a) determining whether a plurality of specific symbols are displayed on the first display in a specific pattern in a basic game or not; (b) starting execution of a second game in a case where at least a predetermined number of the specific symbols are determined to be displayed on the first display; (c) in the second game, displaying a moving symbol on the first display; (d) displaying a plurality of score symbols moving from a first side edge to a second side edge of the second display, where the score symbols are associated with obtained scores and the two side edges are facing each other; (e) displaying the moving symbol upon accepting each input from the input device, the moving symbol running through the first display and moving a predetermined distance over the second display in a direction intersectional to the moving direction of the score symbols displayed on the second display; (f) determining whether the moving symbol superimposes any one of the plurality of score symbols or not; and (g) in a case where the moving symbol is determined to superimpose any one of the plurality of score symbols, providing an award corresponding to a score of the score symbol being superimposed.

The gaming machine of the sixth aspect executes processing of: (a) determining whether a plurality of specific symbols are displayed on the first display in a specific pattern in a basin game; (b) starting execution of a second game in a case where at least a predetermined number of the specific symbols are determined to be displayed on the first display; (c) in the second game, displaying a moving symbol on the first display; (d) displaying a plurality of score symbols moving from a first side edge to a second side edge of the second display, where the score symbols are associated with obtained scores and the side edges are facing each other; (e) displaying the moving symbol upon accepting an input from the input device, the moving symbol running through the first display and moving a predetermined distance over the second display in a direction intersectional to the moving direction of the score symbols displayed on the second display; (f) determining whether the moving symbol superimposes any one of the plurality of score symbols or not; and (g) in a case where the moving symbol is determined to superimpose any one of the plurality of score symbols, providing an award corresponding to a score of the score symbol being superimposed, thus providing an improved entertainment property by providing attractive effects in a second game with a higher payout rate than that of a so-called basic game. In addition, the moving symbol requires a repetitive operation of the input device by the player to reach any one of the score symbols; thus providing more opportunities for the player to be involved in the game and an improved entertainment property.

BRIEF DESCRIPTION OF THE DRAWINGS

FIG. 5 is a diagram showing a format of a symbol data table;

FIG. 14 is a flow chart showing the flow of second game processing executed by the controller of the gaming machine shown in FIG. 11;

DETAILED DESCRIPTION OF THE INVENTION

Figure 1:
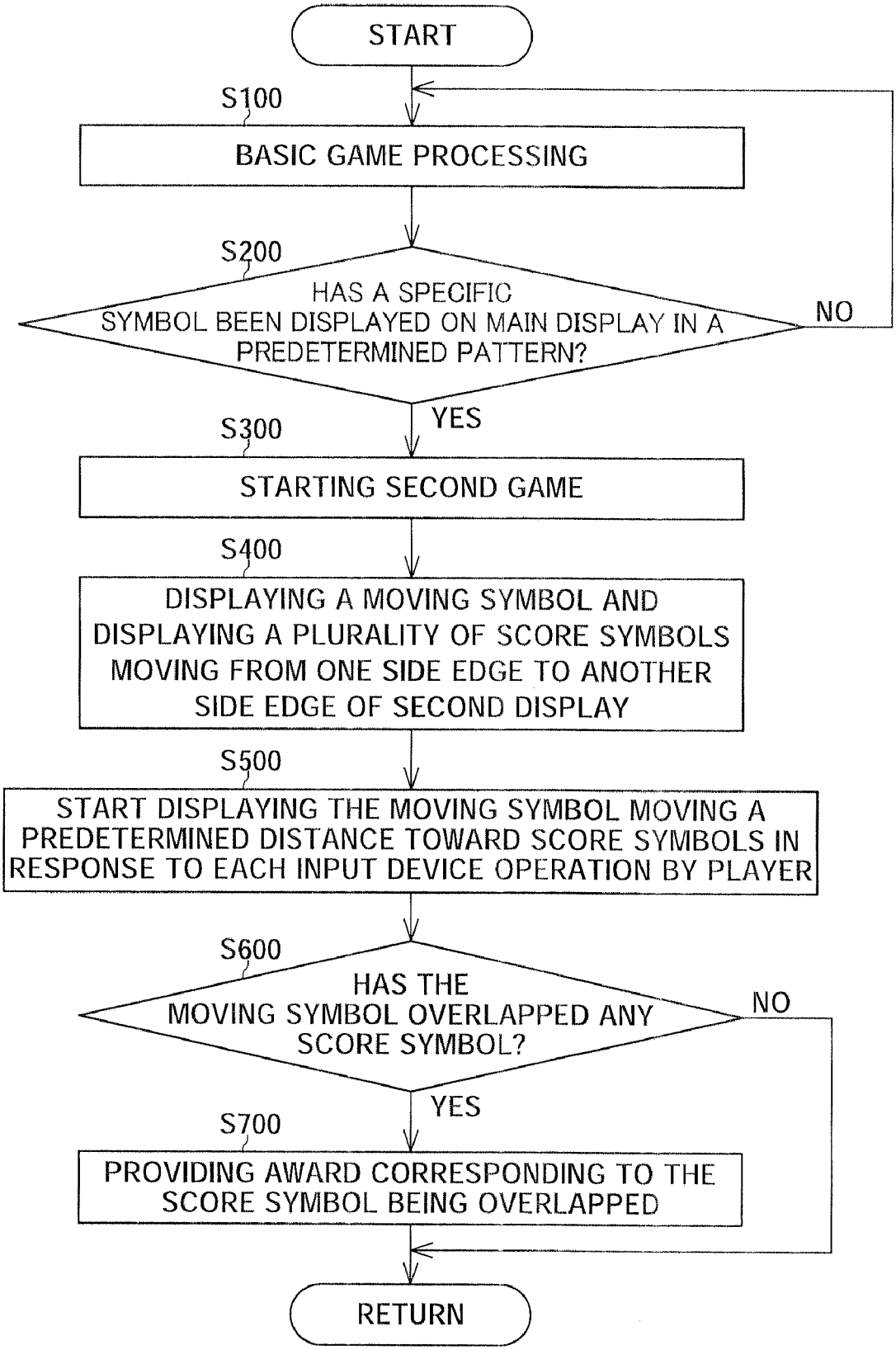
FIG. 1 is a flow chart showing the flow of processing executed in a gaming machine according to an embodiment of the present invention.

The main part of the present invention is first described hereinafter. A gaming machine 15 of the present invention includes a ma in display 30 for displaying images, a rectangular second display 40, an input device 25 for accepting a player's input and a controller 100 (see FIGS. 2 and 3).

As shown in FIG. 1, the controller 100 executes basic processing (Step S100), determines whether a plurality of specific symbols are displayed on the main display 30 in a specific pattern (Step S200), starts a second game in a case where the plurality of specific symbols are determined to be displayed in the specific pattern (Step S300), in the second game, displays a moving symbol on the main display 30, displays a plurality of score symbols moving from a first side edge to a second side edge of the second display 40, where the score symbols are associated with obtained scores and the two side edges are facing each other (Step S400), upon accepting each operation of the input device 25, displays the moving symbol moving in a direction intersectional to the moving direction of the score symbols displayed on the second display 40 (Step S500), determines whether the moving symbol superimposes any one of the plurality of score symbols or not (Step S600), and in a case where the moving symbol is determined to superimpose any one of the plurality of score symbols, provides an award corresponding to a score of the score symbol being superimposed (Step S700). Details are described later.

By executing the abovementioned processing, the present invention can provide a gaming machine providing symbols to be displayed with a variety of effects, to make the game more unpredictable and exciting. Moreover, the present invention can provide attractive effects in a second game with a higher payout rate than that of a so-called basic game. In addition, the moving symbol requires a repetitive operation of the input device by the player to reach any one of the score symbols; thus providing more opportunities for the player to be involved in the game and an improved entertainment property.

A preferred embodiment of the present invention is hereinafter described in detail with reference to the accompanying drawings.

First Embodiment

Figure 2:
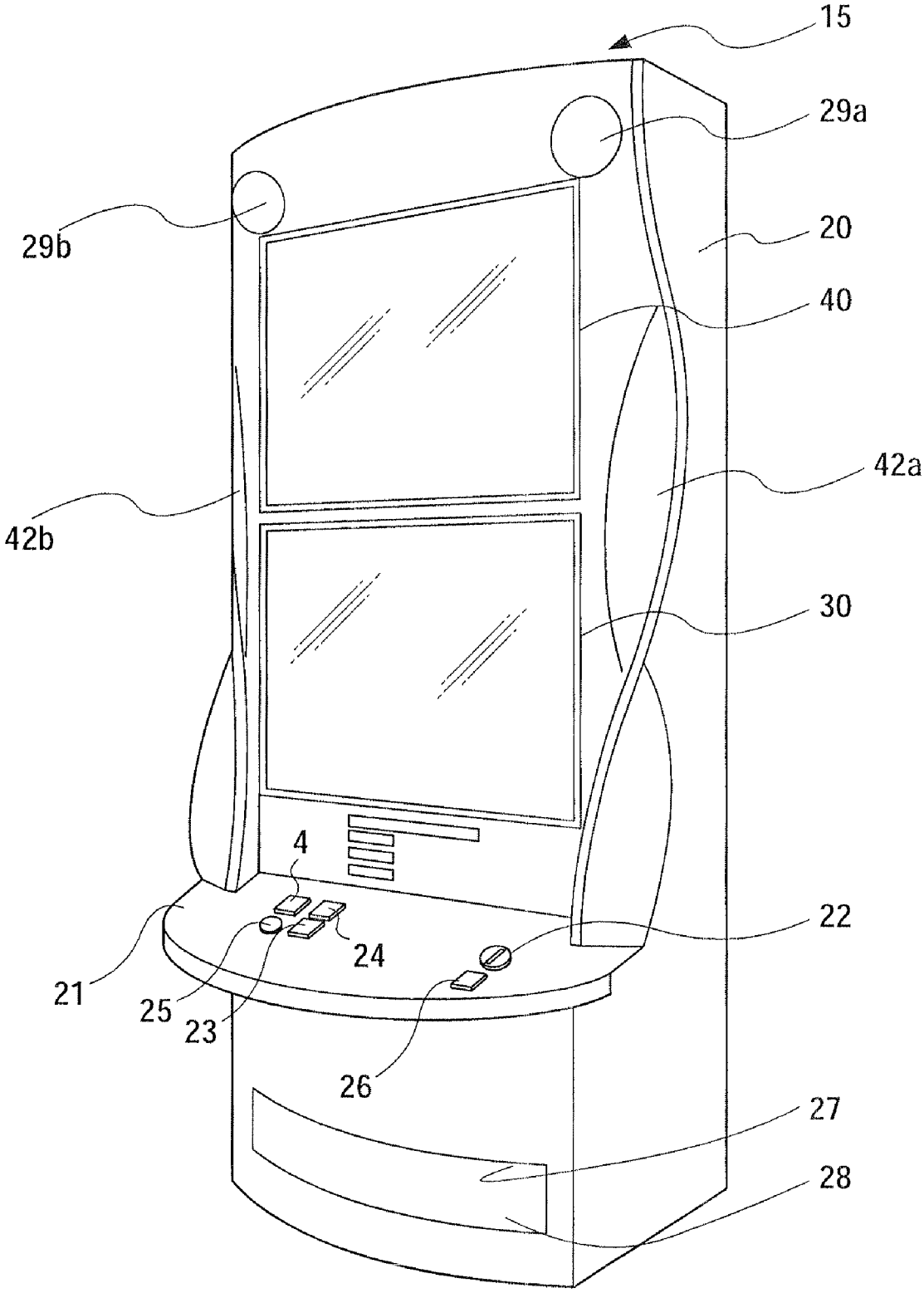
FIG. 2 is a perspective view showing the appearance of the gaming machine according to the first embodiment of the present invention.

The gaming machine 15 of a first embodiment of the present invention is described hereinafter with reference to FIGS. 2 to 10D. FIG. 2 is a block diagram showing the appearance of the gaming machine 15. As shown in FIG. 2, the gaming machine 15 includes a cabinet 20. The tabs net 20 has a surface opening towards a player. The cabinet 20 contains various components including a game controller 100 (refer to FIG. 3) for electrically controlling the gaming machine 15, and a hopper 44 (refer to FIG. 3) for controlling the insertion, storage, and payout of coins (game medium), and the like. The game medium is not limited to coins, and it can be, for example, medals, tokens, electronic money, or electronic valuable information (credits) equivalent thereto.

A main display 30 is disposed at substantially the center of the front face of the cabinet 20, and a second display 40 is disposed above the display 30. The main display 30 and the second display 40 are configured to be liquid crystal panels in the present embodiment.

The main display 30 rearranges the symbol data. A predetermined amount of payout is provided in a case where consecutive symbols are present in a valid region 302. The symbol data is data representing a symbol such as a star in a symbol data table (see FIG. 5). The second display 40 disposed above the main display 30 is a sub display for displaying the rules of the game, demonstration movies, and the like. In addition, the second display 40 displays rendered images in a second game (described later).

Sound transmission openings 29*a* and 29*b* are provided on both the left and right sides above the liquid crystal display 40, which allow the sound effects generated by a speaker 41 (see FIG. 3) stored within the cabinet 20 to propagate outside the cabinet 20. The sound effects are generated from the sound transmission openings 29*a* and 29*b* according to the advancement of the game. In addition, decorative lamps 42*a* and 42*b* are provided on both the left and right sides, substantially in the middle of the gaming machine 13. The decorative lamps 42*a* and 42*b* emit light in accordance with the progress of the game.

A substantially horizontal operation unit 21 is disposed below the liquid crystal display 30. Furthermore, a coin slot 22, which allows the player to insert coins into the slot machine 10, is provided on the right side of the operation unit 21. On the other hand, the components provided to the left side of the operation unit 21 include: a bet switch 23 allowing the player to select the number of coins as a gaming medium to be bet on the symbol data (described later); and a spin repeat bet switch 24 allowing the player to play the game again without changing the number of coins bet or) the symbol data in the previous game. Such an arrangement allows the player to set the number of coins bet on the aforementioned symbol data by pushing either the hot switch 23 or the spin repeat bet switch 24.

In the operation unit 21, a start switch 25, a game starting means for accepting for each game the player's operation of starting a game, is disposed on the left side of the bet switch 23. A pushing operation on either the start switch 25 or the spin repeat bet switch 24 triggers the start of the game, and then the game is started in a predetermined way.

On the other hand, a cash out switch 26 is provided near the coin slot 22 on the aforementioned operation unit 21. When the player presses the cash out switch 26, the inserted coins are discharged from a coin discharge slot 27 opening into a lower portion of the front face of the main door 42. The discharged coins can be gathered on a coin tray 28. The sound transmission openings 29 are provided above the coin tray 28, on both the left and right sides of the coin discharge slot 27, which allow the sound effects generated by a speaker 41 (see FIG. 3) stored within the cabinet 12 to propagate outside the cabinet 12.

Figure 3:
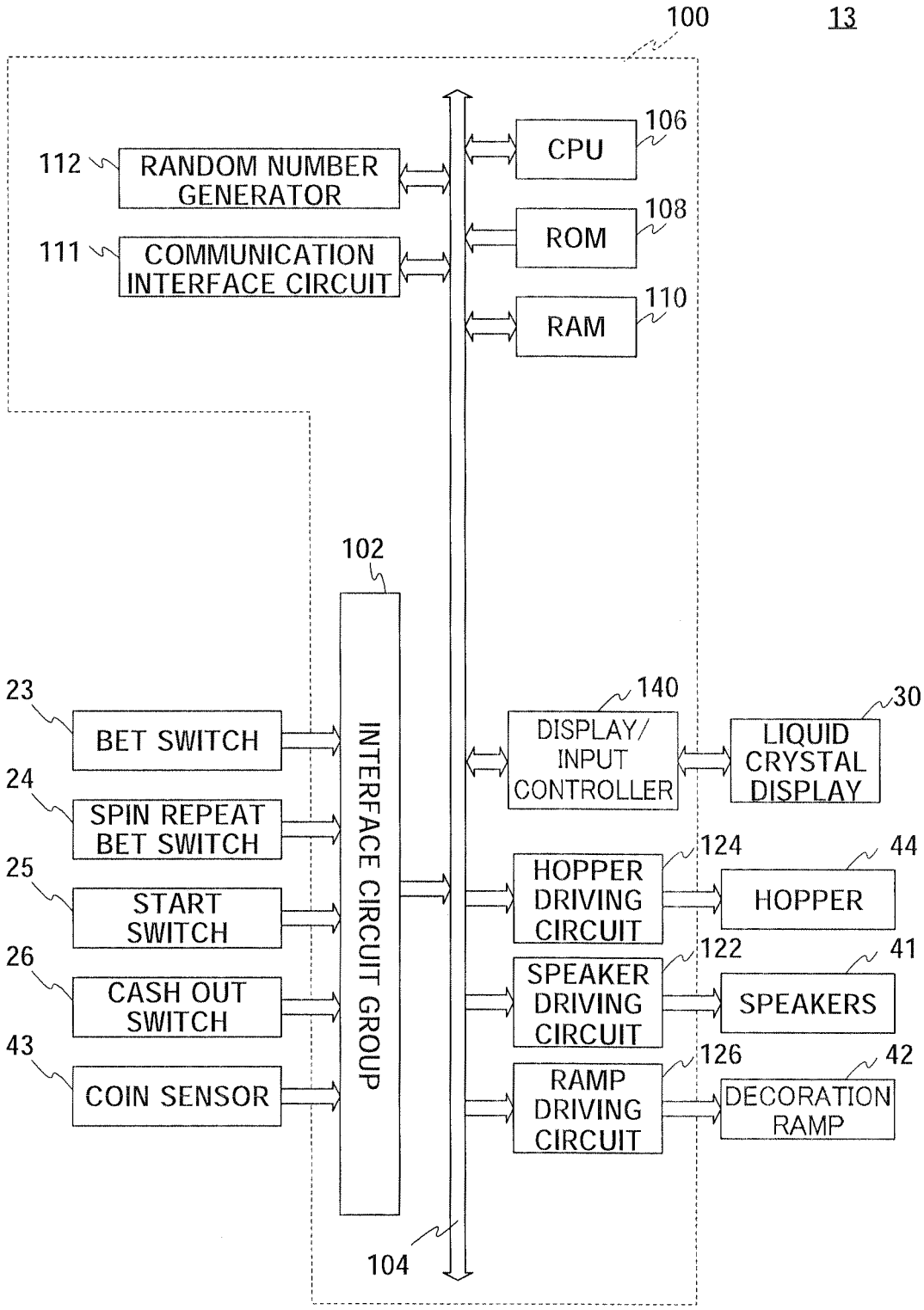
FIG. 3 is a block diagram of a controller of the gaming machine shown in FIG. 2.

FIG. 3 is a block diagram showing the electrical configuration of the game controller 100 of the gaming machine 15. As shown in FIG. 3, the game controller 100 of the gaming machine 15 is a micro computer, and includes an interface circuit group 102, an input/output bus 104, a CPU 106, ROM 100, RAM 110, a communication interface circuit 111, a random number generator 112, a speaker driving circuit 122, a hopper driving circuit 124, a lamp driving circuit 126, and a display/input controller 140.

The interface circuit group 102 is connected to the input/output bus 104. The input/output bus 104 performs input/output of data signals or address signals to and from the CPU 106.

The start switch 25 is connected to the interface circuit group 102. A start signal output from the start switch 25 is converted to a predetermined signal by the interface circuit group 102 and then supplied to the input-output bus 104.

The bet switch 23, the spin repeat bet switch 24, and the cash out switch 26 are also connected to the interface circuit group 102. Each of the switching signals output from these switches 23, 24, and 26 is also supplied to the interface circuit group 102, and is converted into a predetermined form of signal by the interface circuit group 102, then supplied to the input/output bus 109.

A coin sensor 43 is also connected to the interface circuit group 102. The coin sensor 43 is a sensor for detecting the coins inserted into the coin slot 22. The coin sensor 43 is provided in combination with the coin slot 22. A sensing signal outputted from the coin sensor 43 is also supplied to the interface circuit group 102 and converted into a predetermined signal by the interface circuit group 102 and then supplied to the input/output bus 104.

The ROM 108 and the RAM 110 are connected to the input/output bus 104.

Upon acceptance of the start operation of a game from the start switch 25, the CPU 106 reads and executes a game program. The game program starts displaying the scrolling of the symbols on the five video reels on the main display 30 via the display/input controller 140 and then statically display the five video reels, to rearrange the symbols on the five video reels. In a case where a combination of the stationary symbols is displayed along the active pay lines and the combination corresponds to a specific combination for providing an award, the game program pays out an amount of coins corresponding to the specific combination.

Figure 7:
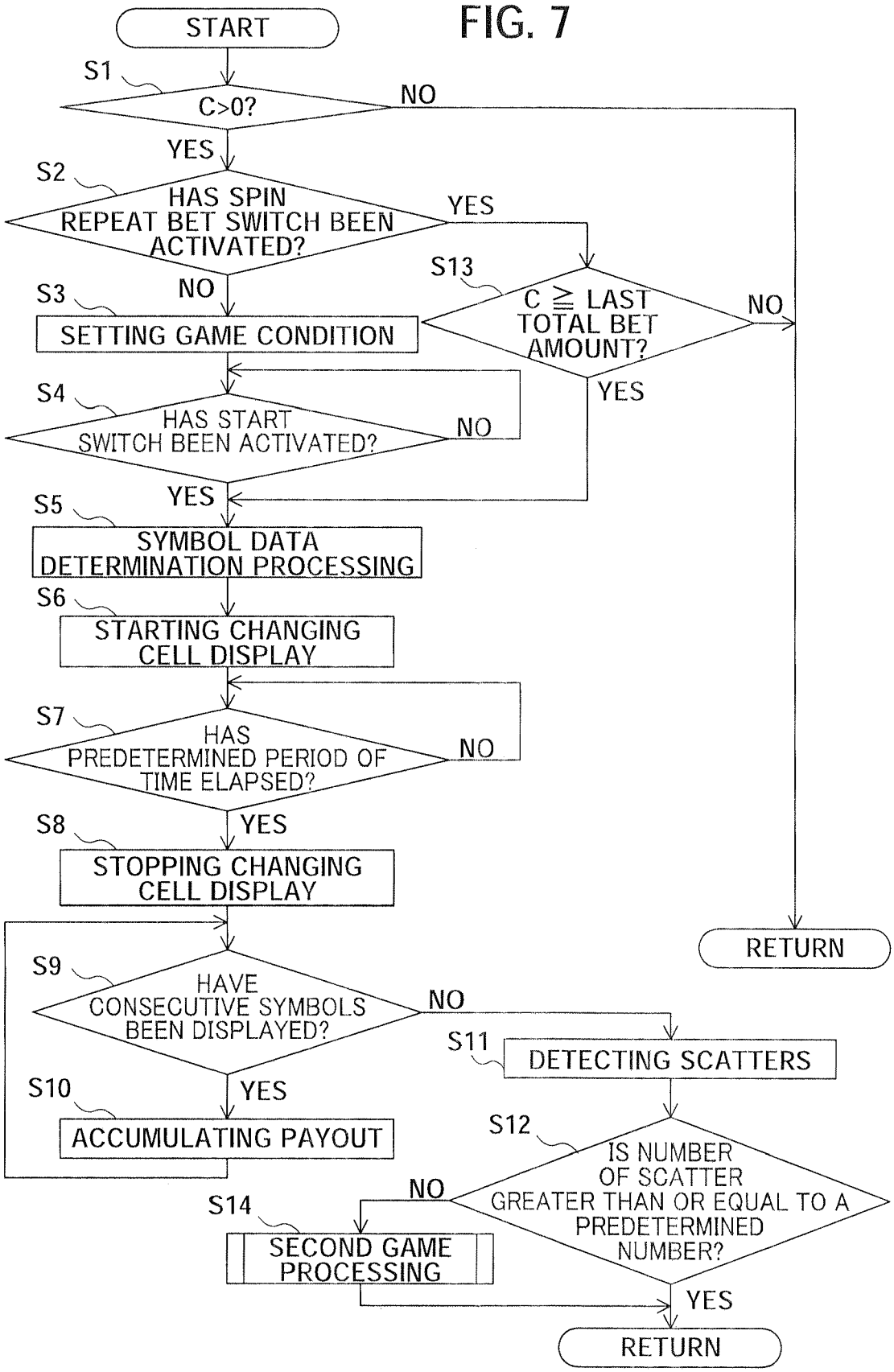
FIG. 7 is a flow chart showing the flow of processing executed by a controller of the gaming machine shown in FIG. 2.
Figure 9:
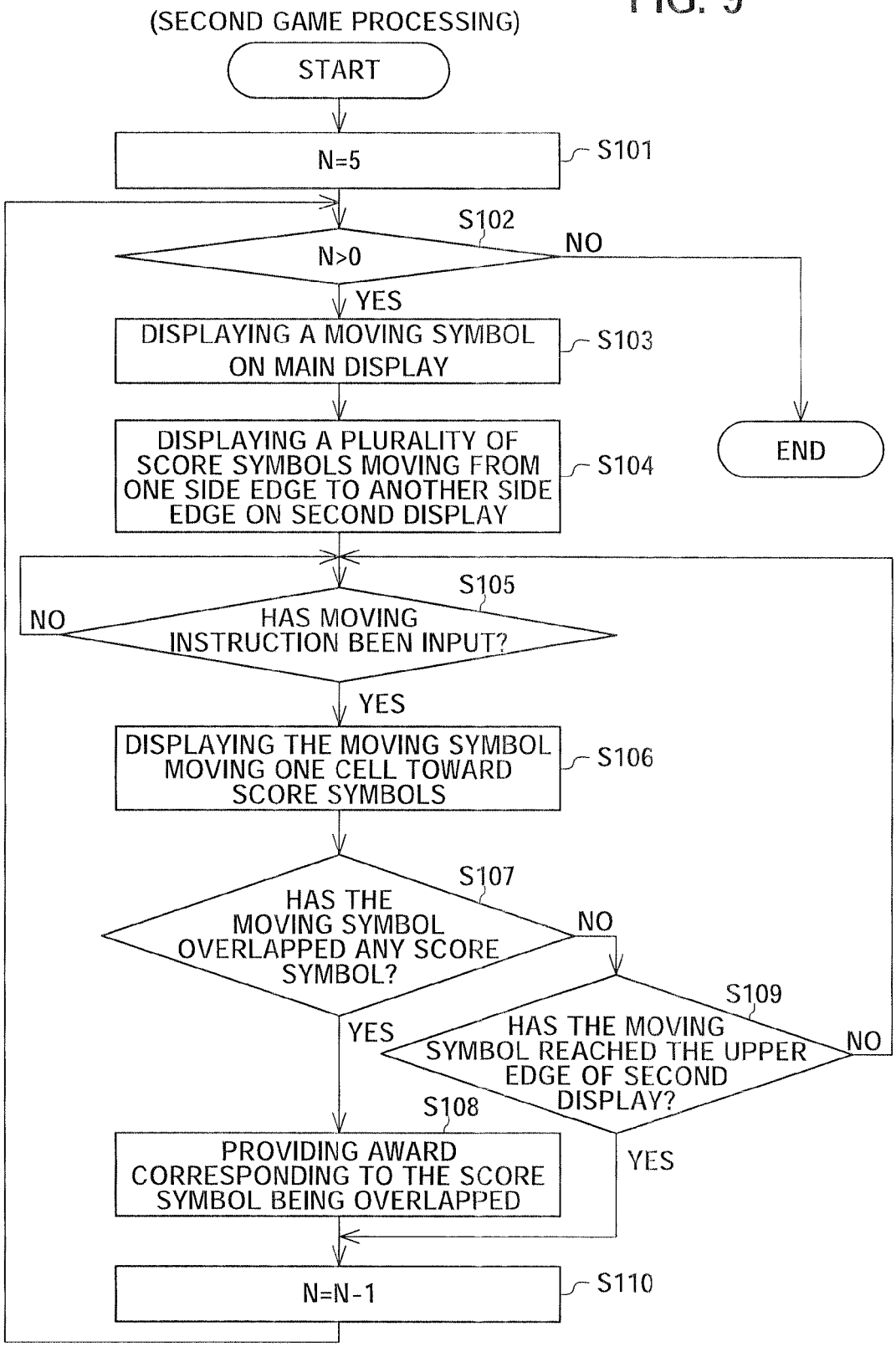
FIG. 9 is a flow chart showing the flow of a second game processing executed by the controller of the gaming machine shown in FIG. 2.

The ROM 108 stores a control program for governing and controlling the gaming machine 13, a program for executing routines as shown in FIGS. 7 and 9 (hereinafter referred to as a "routine execution program"), and initial data for executing the control program, various thresholds including a threshold for determining the number of scatters, which is a condition for making a transition to the second game, and various data tables used in determination processing including a payout table. The routine execution program includes the above-mentioned basic game program. Examples of the data tables include the symbol data table shown in FIG. 5. The RAM 110 temporarily stores the values of flags and variables and the like used in the control program.

A communication interface circuit 111 is also connected to the input/output bus 104. The communication interface circuit 111 is a circuit for communication with a controller in an external administration unit (not shown) and the like over a network including a variety of networks.

A random number generator 112 for generating random numbers is also connected to the input-output bus 104. The random number generator 112 generates random numbers included in a certain range of numerical values, for example, 0 to 65535 (216-1). Alternatively, the random numbers may be generated by the arithmetic processing of the CPU 106.

A speaker driving circuit 122 for driving the speaker 41 is also connected to the input/output bus 104. The CPU 106 reads sound data stored in the ROM 108, and transmits the sound data to the speaker driving circuit 122 via the input/output bus 104. Thus, predetermined sound effects are output from the speaker 41.

A hopper driving circuit 124 for driving the hopper 44 is also connected to the input/output bus 104. Upon receipt of a cash out signal input from the cash out switch 26, the CPU 106 transmits a driving signal to the hopper driving circuit 124 via the input/output bus 104. This enables the hopper 44 to pay out a number of coins corresponding to the credit remaining at that point, which is stored in a predetermined memory area in the RAM 110.

Alternatively, the payout of the coins may be performed in a mode of storing credit data in a data card or the like, instead of using physical coins. That is to say, with such an arrangement, the player may have his/her own card, which serves as a storage medium. Upon the player inserting this card into the gaming machine 15, the data relating to the credit is stored in the card.

A lamp driving circuit 126 is also connected to the input/output bus 104 for driving the decorative lamps 42*a* and 42*b*. The CPU 106 sends signals for driving the lamps under a predetermined condition based on the program stored in the ROM 108, to the lamp driving circuit 126. This makes the decorative lamps 42*a* and 42*b* blink and the like.

The display/input controller 140 is also connected to the input/output bus 104. The CPU 106 generates an image display instruction according to the state of the game and the result of the game, and outputs the generated image display instruction to the display/input controller 140 via the input/output bus 104. Upon reception of the image display instruction input from the CPU 106, the display/input controller 140 generates a driving signal for driving the main display 30 according to the image display instruction, and outputs the driving signal thus generated to the main display 30. As a result, a predetermined image is displayed on the main display 30. The display/input controller 140 also includes a touch panel 412 on the surface of the liquid crystal display 30. The display/input (controller 140 transmits the signal input through the touch panel 412 to the CPU 106 via the input/output bus 104, in the form of an input signal. It should be noted that the image display instructions include instructions relating to the payout amount display unit 48, the credit amount display unit 49, and the bet amount display unit 50.

Figure 4:
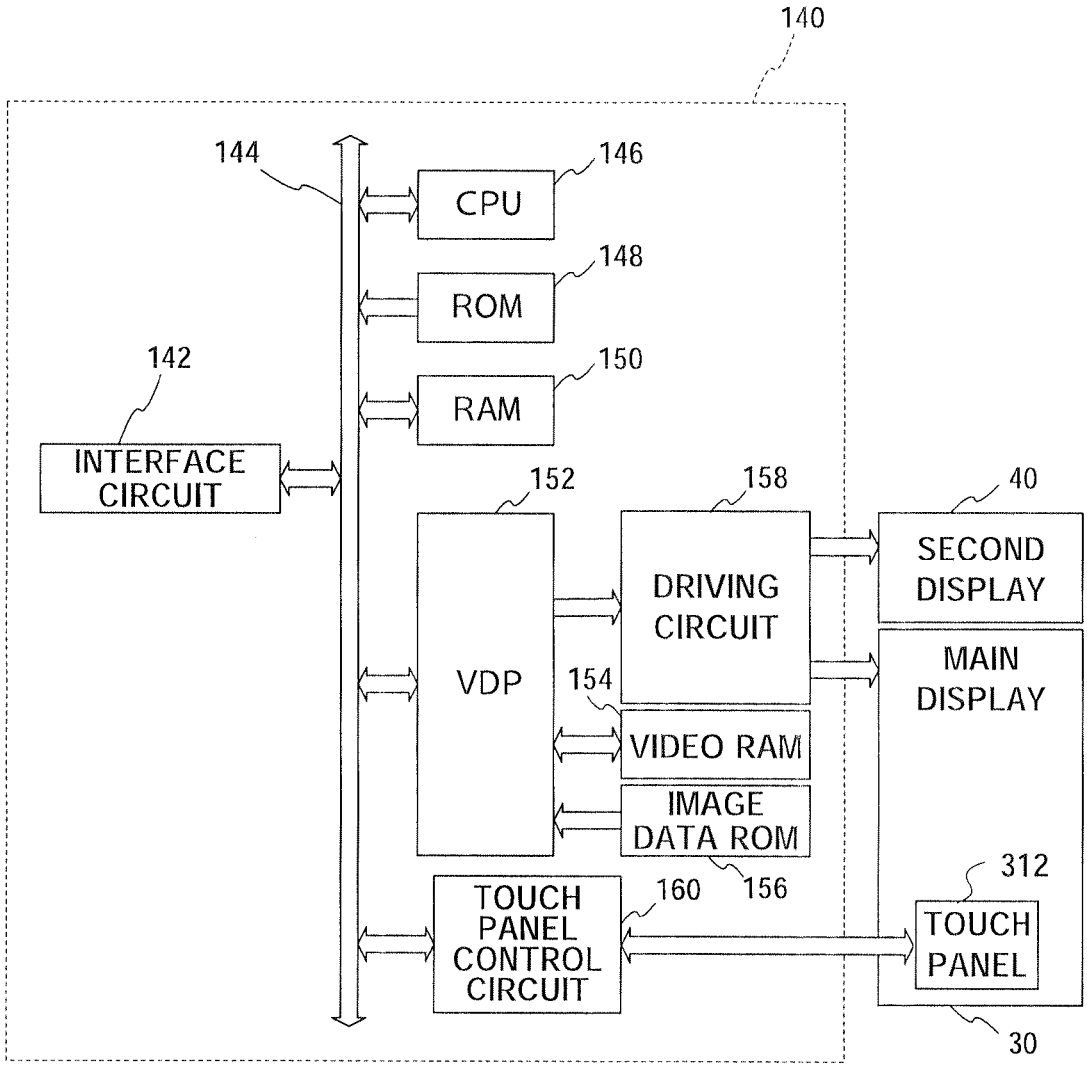
FIG. 4 is a block diagram of a display/input controller of the gaming machine shown in FIG. 2.

FIG. 4 is a block diagram showing the electrical configuration of the display/input controller 140 of the gaming machine 15. The display/input controller 140 of the gaming machine 15 is a sub-microcomputer for performing image display processing and input control for the touch panel 412. The display/input controller 140 includes an interface circuit 142, an input/output bus 144, a CPU 146, ROM 148, RAM 150, a VDP 152, video RAM 154, image data ROM 156, a driving circuit 158, and a touch panel control circuit 160.

The interface circuit 142 is connected to the input/output bus 144. An image display command output from the CPU 106 of the game controller 100 is supplied to the input/output bus 144 via the interface circuit 142. The input/output bus 144 performs input/output of data signals or address signals to and from the CPU 146.

The ROM 148 and RAM 150 are connected to the input/output bus 144. The ROM 148 stores a display control program for generating a driving signal, which is to be supplied to the main display 30, according to an image display command received from the CPU 106 of the aforementioned game controller 100. On the other hand, the RAM 1550 stores flags and values of variables used in the display control program.

The VDP 152 is also connected to the input/output bus 144. The VDP 152 is a processing device including a so-called sprite circuit a screen circuit, a palette circuit and the like, and is capable of performing a variety of processing for displaying an image on the main display 30. The video RAM 154 and the image data ROM 156 are connected to the VDP 152. The video RAM 154 stores image data based on the image display instructions from the CPU 106 on the game controller 100. The image data ROM 156 stores various kinds of image data containing the abovementioned effect image data, various symbols and the like. Furthermore, the driving circuit 158 for outputting a driving signal for driving the main display 30 and the second display 40 is connected to the VDP 152.

By reading and executing the display control program stored in the ROM 148, the CPU 146 instructs the video RAM 154 to store image data to be displayed on the main display 30 and the second display 40 in response to the image display instructions from the CPU 106 on the game controller 100. The image display instruction includes various types of image display instructions, such as the abovementioned display instruction of rendered images.

The image data ROM 156 stores various kinds of image data including rendered image data.

The touch panel control circuit 160 transmits to the CPU 106 the signals input via the touch panel 412, provided on the second display 40, via the input/output bus 144, in the form of an input signal.

FIG. 5 shows a table defining relationship between symbol data, payout amount, and attributes.

The column "symbol data" shows symbol data to be rearranged in cells on the display. The column "standard payout amount" shows the payout amounts to be provided for consecutive symbols. For example, three consecutive symbols provide an amount three times greater than the standard payout amount. The column "full consecutive symbols payout amounts" shows payout amounts further provided in a case where the valid region is filled with consecutive symbols of the same kind, i.e. with symbol data having the same attributes. For example, in a case where the valid region of 15 (3×5) cells is filled only with star symbols, 2500 (100×15+1000) credits are paid out. The column "probability of appearance" shows probability of each symbol data to be rearranged in cells. The column "attribute value" shows a concrete value of an attribute for each symbol data.

Figure 6:
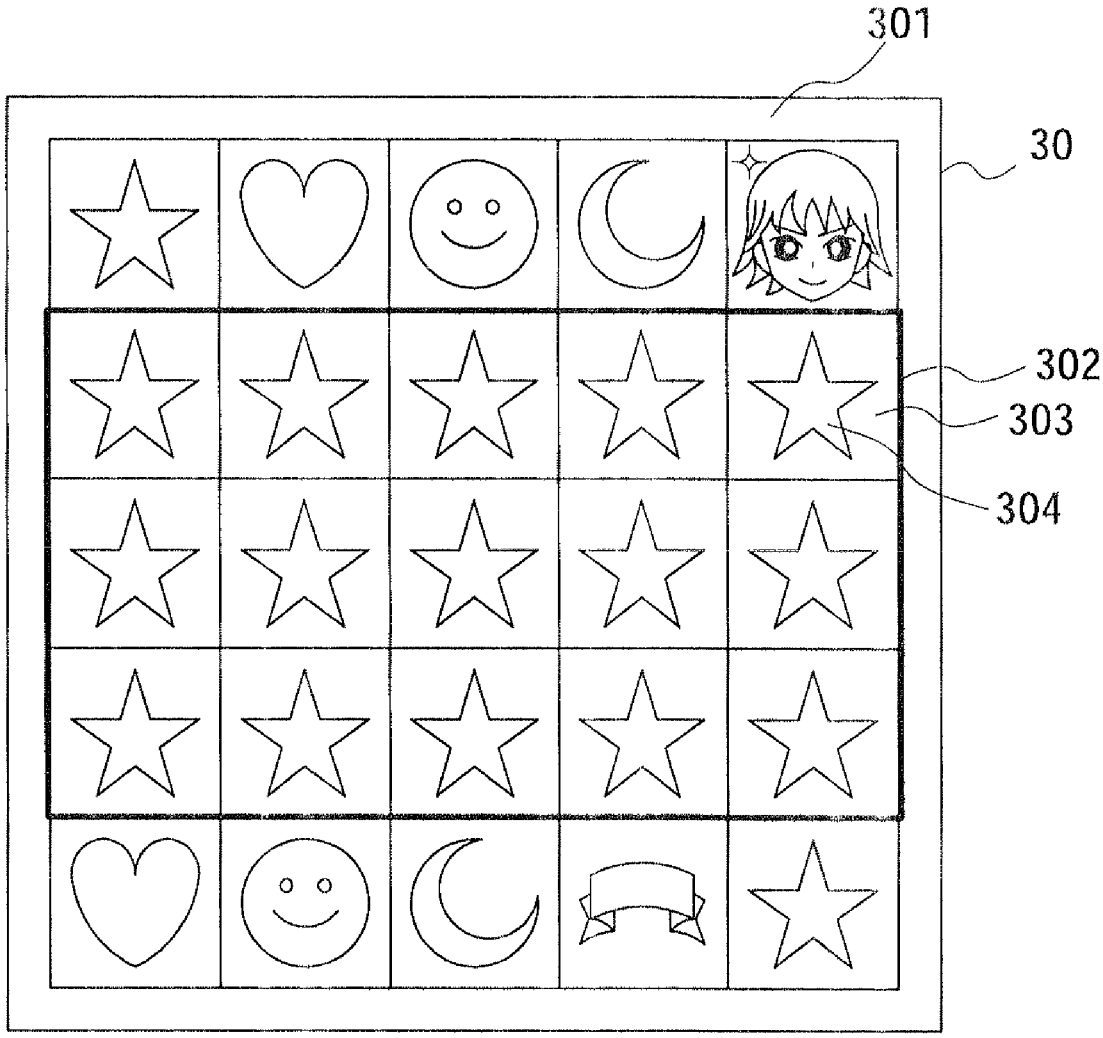
FIG. 6 is a diagram showing an example of symbols displayed on the main display.

FIG. 6 is a display example of a case where the symbol data, a star, is rearranged in all the cells in the valid region 302 and the valid region is filled with a group of consecutive symbols.

The window 301 on the display 30 consists of cells 303 arranged in a matrix. In the present embodiment, the window 301 is of cells 303 arranged in a matrix of 5 rows by 5 columns. The controller arranges and displays symbol data 304 in each cell 303. The cells 303 are numbered hereinafter for explanation. A cell can consist of a virtual reel with symbol data arranged on the outer periphery thereof. In this case, a stop position of the reel is randomly selected and the symbol data arranged in the position is displayed. A cell at row 1, column 1 displaying a star symbol is hereinafter referred to as a cell 11 and a cell at row 1, column 5 displaying a face symbol is hereinafter referred to as cell 15. Similarly, a cell at row 5, column 1 displaying a heart symbol is hereinafter referred to as cell 51 and a cell at row 5, column 5 displaying a star symbol is hereinafter referred to as cell 55. In the present embodiment, the valid region 302 is a region enclosed by a bold line, in other words, the cells 21 to 45 (the cells are hereinafter referred to with the numbers).

In this case, a payout amount is calculated on the basis of the 15 consecutive symbols (star) and the valid region filled with symbol data of the same attribute. According to the symbol data table of the present embodiment, the payout amount is 100×15+1000=2500 credits.

Figure 8:
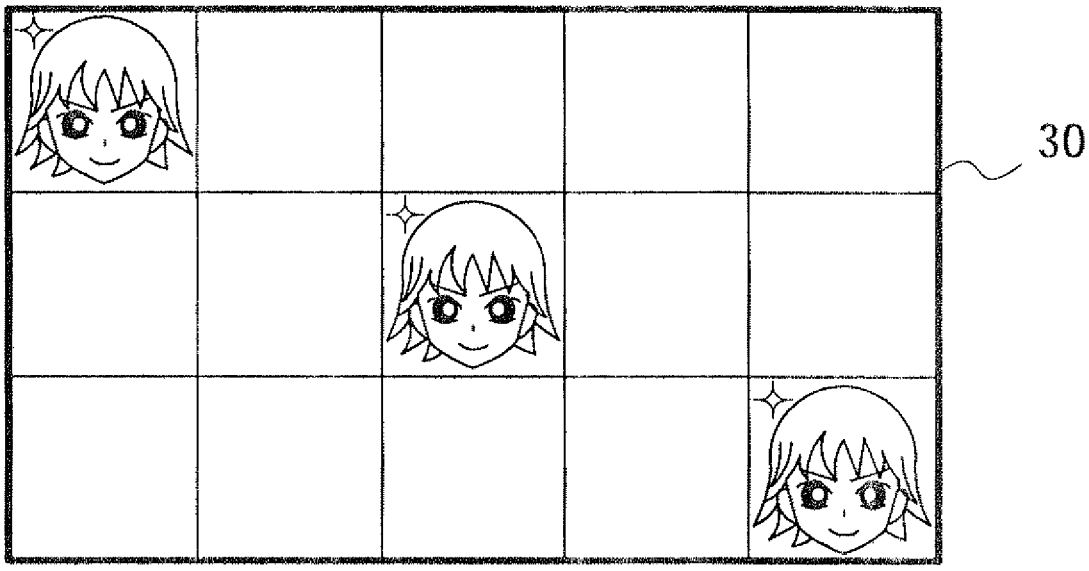
FIG. 8 is a diagram showing an example of a symbol pattern qualified for making a transition to a second game.

In the present embodiment, the face symbol is a scatter symbol. As shown in FIG. 8, in a case where the scatter symbol is arranged in at least 3 cells, a second game can be executed up to 5 times.

FIGS. 7 and 9 show routines for controlling the gaming machine 15, executed by the controller 100. The series of routines shown in FIG. 7 is called and executed at a predetermined timing by a main program of the gaming machine 15 that is executed in advance.

It is supposed that the gaming machine 15 is activated in advance and the variables used in the CPU 106 on the controller 100 are initialized to predetermined values, respectively, thereby providing a stationary action of the gaming machine 15.

Examples of the variables include a rearranged state table storing symbol data arranged on each cell, a consecutive symbol state list representing the state of consecutive symbols, a payout amount variable accumulatively storing a calculated payout amount, and the like.

Flow of the processing operation in the game is described with reference to FIG. 7.

First, the CPU 106 on the controller 100 determines whether certain credits as the number of remaining coins inserted by the player remain (Step S1). More specifically, the CPU 106 reads a credit number C stored in the RAM 110, and performs processing based on the read credit number C. In a case that the credit amount C is "0" (in the case of a NO determination in Step S1), the CPU 106 is not permitted to start the game. Accordingly, in this case, the CPU 106 ends this routine without performing any processing. On the other hand, in a case where the credit amount C is at least 1 (in the case of a YES determination in Step S1), the CPU 106 determines that there is credit remaining, and accordingly, advances to Step S2.

In Step S2, the CPU 106 determines whether a pushing operation has been performed, on the spin repeat bet switch 24. In a case where the spin repeat bet switch 24 has been pushed, and accordingly, in a case of reception of an operation signal via the spin repeat switch 24 (in the case of a YES determination in Step S2), the CPU 106 advances to Step S13. On the other hand, in a case of no reception of an operation signal via the spin repeat switch 24 during a predetermined period of time (in the case of a NO determination in Step S2), the CPU 106 determines that the spin repeat bet switch 24 has not been pushed, and accordingly, advances to Step S3.

In Step S3, a game condition is set. More specifically, the CPU 106 determines the number of coins to be bet on the symbol data in the current game according to the user's operation via the bet switch 23. In this step, the CPU 106 receives an operation signal generated by the user's operation performed via the bet switch 23. The CPU 106 determines the bet amount for the activated symbol data based upon the number of instances of reception of the bet switch operation signal, and stores the bet amount thus determined in a predetermined memory region in the RAM 110. The CPU 106 reads the credit number C written in the predetermined memory area of the RAM 110, and subtracts the total number of bets including the aforesaid number of bets from the read credit number C. Then, the CPU 106 causes the resulting value to be stored in a predetermined memory area of the RAM 110. The CPU 106 then moves on to Step S4.

In Step S4, the CPU 106 waits for the operation of the start switch 25 by determining whether the start switch is ON or not. When the start switch 25 is operated and an operation signal from the start switch 25 is then inputted (when the result is YES in Step S4), the CPU 106 decides that the start switch 25 has been operated, and then moves on to Step S5.

On the other hand, in Step S13, the CPU 106 determines whether or not the credit amount C is at least the total bet amount in the previous game. In other words, the CPU 106 determines whether or not the player can start the game by pushing the spin repeat bet switch 24. More specifically, in a case where the spin repeat bet switch 24 has been pushed, and accordingly, in a case that the operation signal has been input from the aforementioned switch 24, the CPU 106 reads out the credit amount C and the bet amount bet on the symbol data in the previous game stored in the predetermined memory areas of the aforementioned RAM 110. Then, the CPU 106 determines whether or not the aforementioned credit amount C is at least the total bet amount bet in the previous game based upon the relation between the credit amount C and the bet amounts thus read out. The CPU 106 performs processing based upon the determination results. In a case that the aforementioned credit amount C is determined to be less than the total bet amount bet on the previous game (in a case of a NO determination in Step S13), the CPU 106 cannot start the game, and accordingly, terminates this routine without performing any processing. On the other hand, in a case where a determination has been made that the aforementioned credit amount C is at least the total bet amount bet in the previous game (in a case of a YES determination in Step S13), the CPU 106 subtracts the total bet amount bet in the previous game from the aforementioned credit amount C, and stores the subtracted value in a predetermined area of the RAM 110. The CPU 106 then advances to step S5.

In Step S5, the CPU 106 performs symbol data determination processing. More specifically, the symbol data determination processing is as follows.

In the symbol data determination processing, the CPU 106 first determines symbol data to be rearranged in the valid region. More specifically, the CPU 106 issues an order of generating a random number to a random number generator 112, and extracts a random number in a predetermined range (0 to 65535 in the present embodiment) generated by the random number generator 112. The CPU 106 stores the random number thus extracted in a predetermined memory region in the RAM 110. In the present embodiment, random numbers can be generated in the random number generator 112 disposed outside the CPU 106. Alternatively, random numbers may be generated by the arithmetic operation of the CPU 106, without providing the random number generator 112. The CPU 106 reads a value of probability of appearance of the symbol data stored in the ROM 108 (see FIG. 5), and stores the value of probability of appearance of the symbol data thus read in a predetermined memory region in the RAM 110. The CPU 106 reads the value of probability of appearance of the symbol data stored in the predetermined memory region in the RAM 110, references the value of probability of appearance by passing the random number written to the predetermined memory region in the RAM 110 as a parameter, and thus determines symbol data to be rearranged. The CPU 106 stores the symbol data thus determined in a predetermined memory region in the RAM 110. The CPU 106 determines the symbol data for all the cells and stores it in a rearranged state table in the RAM 110.

In Step S6, the CPU 106 displays a varying image in each cell. More specifically, the CPU 106 displays symbol data in each cell and instructs a CPU 206 to change the symbol data sequentially or simultaneously. The CPU 206 displays symbol data on the main display 30 via the VDP 212, in response to the image displaying instruction.

After displaying and changing the image in each cell, the CPU 106 waits for a predetermined period of time to elapse (Step S7). After the predetermined period of time has elapsed (at the moment of a YES determination in Step S7), the CPU 106 automatically stops variation of the image in each cell (Step S8). More specifically, the CPU 106 stops, sequentially or simultaneously, displaying the symbol data determined in Step S5 based upon the symbol data written to the predetermined memory region in the RAM 110. The CPU 106 then advances to Step S9.

In Step S9, the CPU 106 determines whether there are consecutive symbols or not. More specifically, the CPU 106 calculates payout and references a return value that is a payout amount. In a case where the return value is 0, the CPU 106 determines that there are not consecutive symbols, and advances to Step S11. In a case where the return value is not 0, the CPU 106 determines that there are consecutive symbols, and advances to Step S10.

In Step S10, the CPU 106 accumulates the payout amount. More specifically, the CPU 106 adds the payout amount, which is the return value of the consecutive symbols processing, to the payout amount variable. Then, the CPU 106 performs symbol data downward moving processing, returns, and advances to Step 9.

In Step S11, the CPU 106 performs a scatter processing. More specifically, the CPU 106 references a scatter symbol in the rearranged state table. In a case where the scatter symbol is present, the number thereof is calculated. Subsequently, the CPU 106 advances to Step S12.

In Step S12, the CPU 106 determines whether the number of the scatter symbols is at least a predetermined number. More specifically, the CPU 106 determines whether or not the number of the scatter symbols calculated in Step S11 is at least a threshold stored in the ROM 108: in this case, 3. In a case where the number of the scatter symbols is determined to be at least 3, the CPU 106 advances to Step S14. In a case where the number of the scatter symbols is determined to be less than 3, the CPU 106 terminates the present routine.

In Step S14, the CPU 106 performs second game processing.

The second game processing is hereinafter described with reference to FIG. 9.

First, in Step S101, the CPU 106 sets a value 5 for N, the N representing how many time the present routine can be executed. More specifically, the CPU 106 stores N=5, as an initial value for the present processing, in the RAM 110. The CPU 106 then advances to Step S102.

In Step S102, the CPU 106 determines whether the N is greater than 0 or not. More specifically, the CPU 106 reads the N stored in the RAM 110, and determines whether the N is greater than 0 or not. In a case where the N is determined to be greater than 0 (in the case of a YES determination in Step S102), the CPU 106 advances to Step S103. In a case where the N is determined not to be greater than 0 (in the case of a NO determination in Step S102), the CPU 106 terminates the present routine.

Figure 10A:
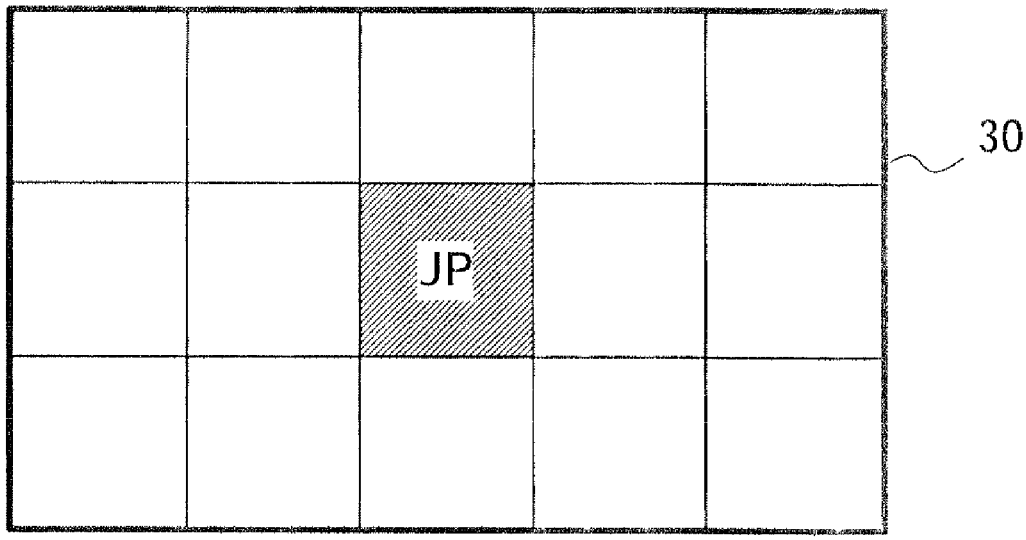
FIG. 10A is a diagram showing a JACKPOT symbol shown on the main display.
Figure 10B:
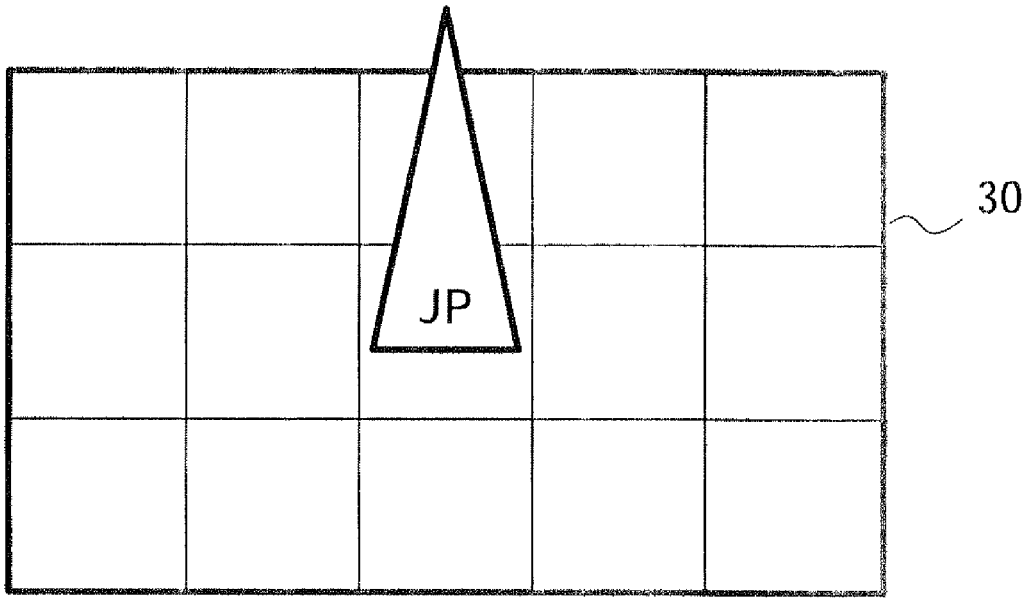
FIG. 10B is a diagram showing a moving symbol shown on the main display.

In Step S103, the CPU 106 displays a moving symbol on the main display 30. More specifically, the CPU 106 changes the image data and the like on the display window on the main display 30, which is stored in the video RAM 154, on the basis of the image data stored in the image data ROM 156, thus displaying a moving symbol. First, as shown in FIG. 10A, the CPU 106 displays a JACKPOT symbol having letters JP (JackPot) in one of the cells in the main display 30, to highlight the cell. Subsequently, as shown in FIG. 10B, the CPU 106 changes the letters JP into an isosceles triangle with a sharp edge, which is a moving symbol. The CPU 106 then advances to Step S104.

Figure 10C:
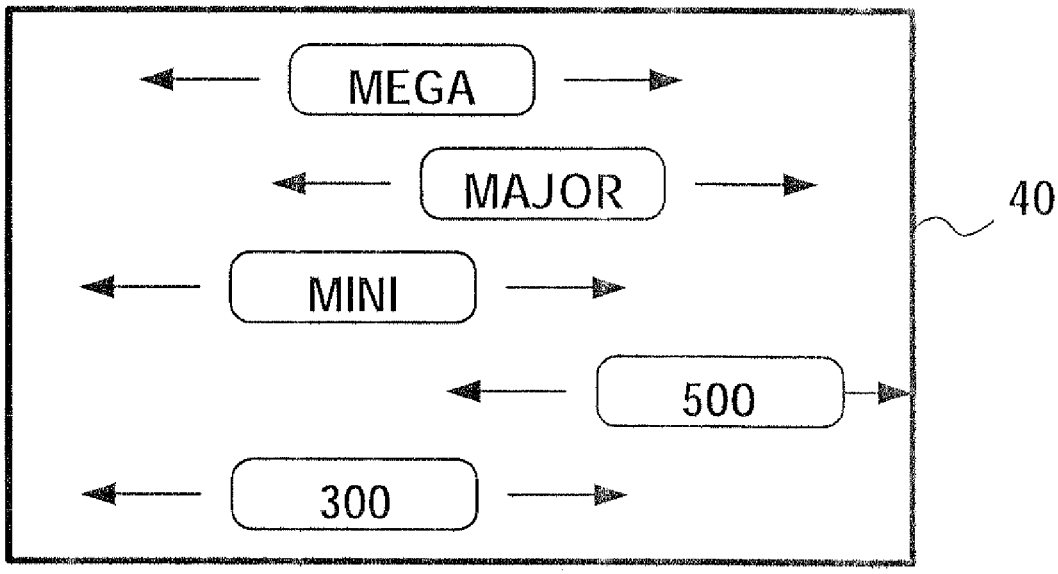
FIG. 10C is a diagram showing score symbols shown on the second display.

In Step S104, the CPU 106 displays a plurality of score symbols moving back and forth between a first side edge and a second side edge of the second display 40. More specifically, the CPU 106 changes the image data on the display window of the second display 40, which is stored in the video RAM 154 based upon the image data stored in the image data ROM 156, the symbol data of the score symbol written to the predetermined memory region in the RAM 110, and the like, to display the plurality of score symbols "MEGA", "MAJOR", "MINI", "500", and "300" that are moving between a first side edge and a second side edge of the rectangular second display 40 in the directions of arrows, as shown in FIG. 10C. The CPU 106 then advances to Step S105. Scores are associated with the score symbol and the score information is also stored in the symbol data table in the RAM 110, such as 100000 points for the "MEGA" symbol, 50000 points for the "MAJOR" symbol, 1000 points for the "MINI" symbol, 500 points for the "500" symbol, and 300 points for the "300" symbol.

In Step S105, the CPU 106 determines whether a moving instruction has been input or not. More specifically, the CPU 106 waits for the spin repeat bet switch 24 to be pushed, and accordingly, an operation signal to be input via the spin repeat switch 24. In a case where the spin repeat bet switch 24 has been pushed, and accordingly, in a case of reception of an operation signal via the spin repeat switch 24 (in the case of YES determination in Step S105), the CPU 106 determines that the moving instruction has been input and advances to Step S106.

In Step S106, the CPU 106 displays the moving symbols moving one cell toward the score symbols. In the present embodiment, the moving symbol moves one cell; however, the moving symbol can move any predetermined distance. More specifically, the CPU 106 changes the image data on the display window of the main display 30, which is stored in the video RAM 154 based upon the image data stored in the image data ROM 156 or the image data on the display window of the second display 40, the symbol data of the moving symbol written to the predetermined memory region in the RAM 110, and the like, to display the moving symbol moving toward the score symbols moving from a first side edge to a second side edge of the second display 40 (see FIG. 10C). After that the moving symbol reaches the upper edge of the main display 30 and then moves from the lower edge of the second display, this step is repeated until the moving symbol reaches any score symbol or the upper edge of the second display 40. The CPU 106 then advances to Step S107.

In Step S107, the CPU 106 determines whether the moving symbol superimposes any score symbol or not. More specifically, the CPU 106 references the symbol data written to the predetermined memory region in the RAM 110 and determines whether the moving symbol superimposes any score symbol. In a case where the moving symbol is determined to superimpose any score symbol (in the case of a YES determination in Step S107) the CPU 106 advances to Step S108, and in a case where the moving symbol is determined not to superimpose any score symbol (in the case of a NO determination in Step S107), the CPU 106 advances to Step S109.

Figure 10D:
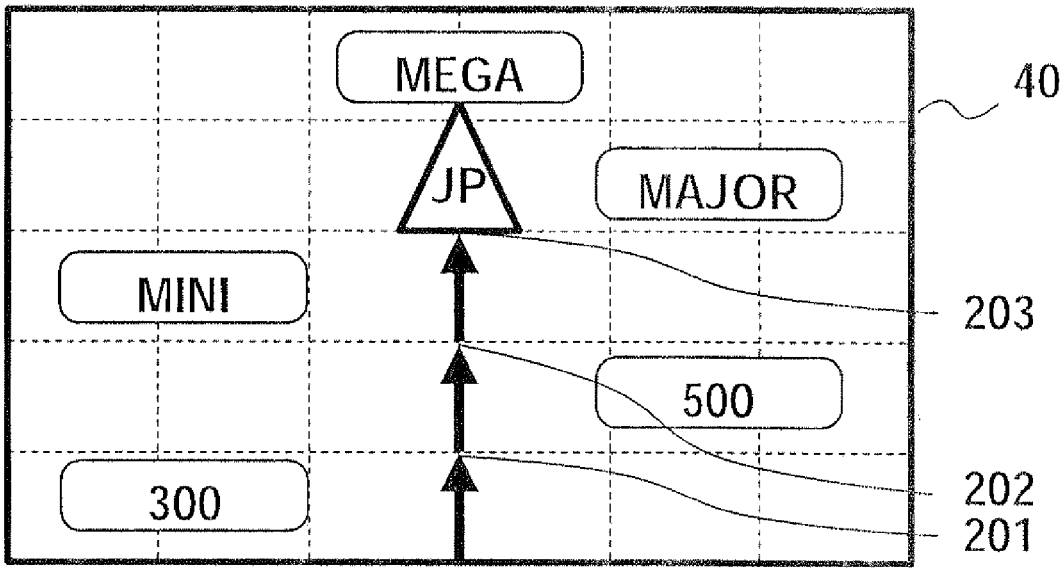
FIG. 10D is a diagram showing an example of the moving symbol superimposing one of the score symbols on the second display.

In Step S108, the CPU 106 provides an award in accordance with the score symbol being superimposed. More specifically, the CPU 106 references the symbol data stored in the predetermined memory region in the RAM 110, and pays out an award corresponding to the score associated with the score symbol being superimposed by the moving symbol. For example, the CPU 106 pays out 100000 points in a case where the moving symbol superimposes the "MEGA" symbol, as shown in FIG. 10D. The CPU 106 then advances to Step S110.

In Step S109, the CPU 106 determines whether the moving symbol has reached the upper edge of the second display 40 or not. More specifically, the CPU 106 references the symbol data stored in the predetermined memory region in the RAM 110 and determines whether the moving symbol has reached the upper edge of the second display. In a case where the moving symbol is determined to have reached the upper edge (in the case of a YES determination in Step S109), the CPU 106 advances to Step S110, and in a case where the moving symbol is determined to not have reached the upper edge (in the case of a NO determination in Step S109), the CPU 106 advances to Step S100).

In Step S110, the CPU 106 subtracts 1 from the N stored in the RAM 110. The CPU 106 then advances to Step S102.

As described above, the gaming machine 15 of the present invention can significantly reflect the player's intention on the behavior of the moving symbol by displaying the score symbols and a moving symbol on the display during a second game and moving the moving symbol toward the score symbol in accordance with the moving instruction from the player. Moreover, the present invention can provide improved entertainment properties by displaying the score symbols and a moving symbol in a second game with a higher payout rate, of coins and the like, than that of a so-called basic game. In addition, the moving symbol requires a repetitive operation of the input device by the player to reach any one of the score symbols; thus reflecting the player's intention directly to the game.

The moving symbol starts moving in response to a pushing operation of the spin repeat bet switch 24 in the present embodiment; however, the present invention is not limited thereto and the moving symbol can start moving in response to a pushing operation of the bet switch 23, the start switch 25, the touch panel 412 and the like.

Second Embodiment

The gaming machine 15 of a second embodiment of the present invention is described hereinafter with reference to FIGS. 11 to 16. In the gaming machine of the present embodiment, a main display and a second display are constituted of touch panels that allow the moving symbol to move freely by touching the main display or the second display to slightly adjust the trajectory of the moving symbol in the second game. Configurations and operations that are similar to that of the first embodiment are referred to with the same reference number and descriptions thereof are omitted.

Figure 11:
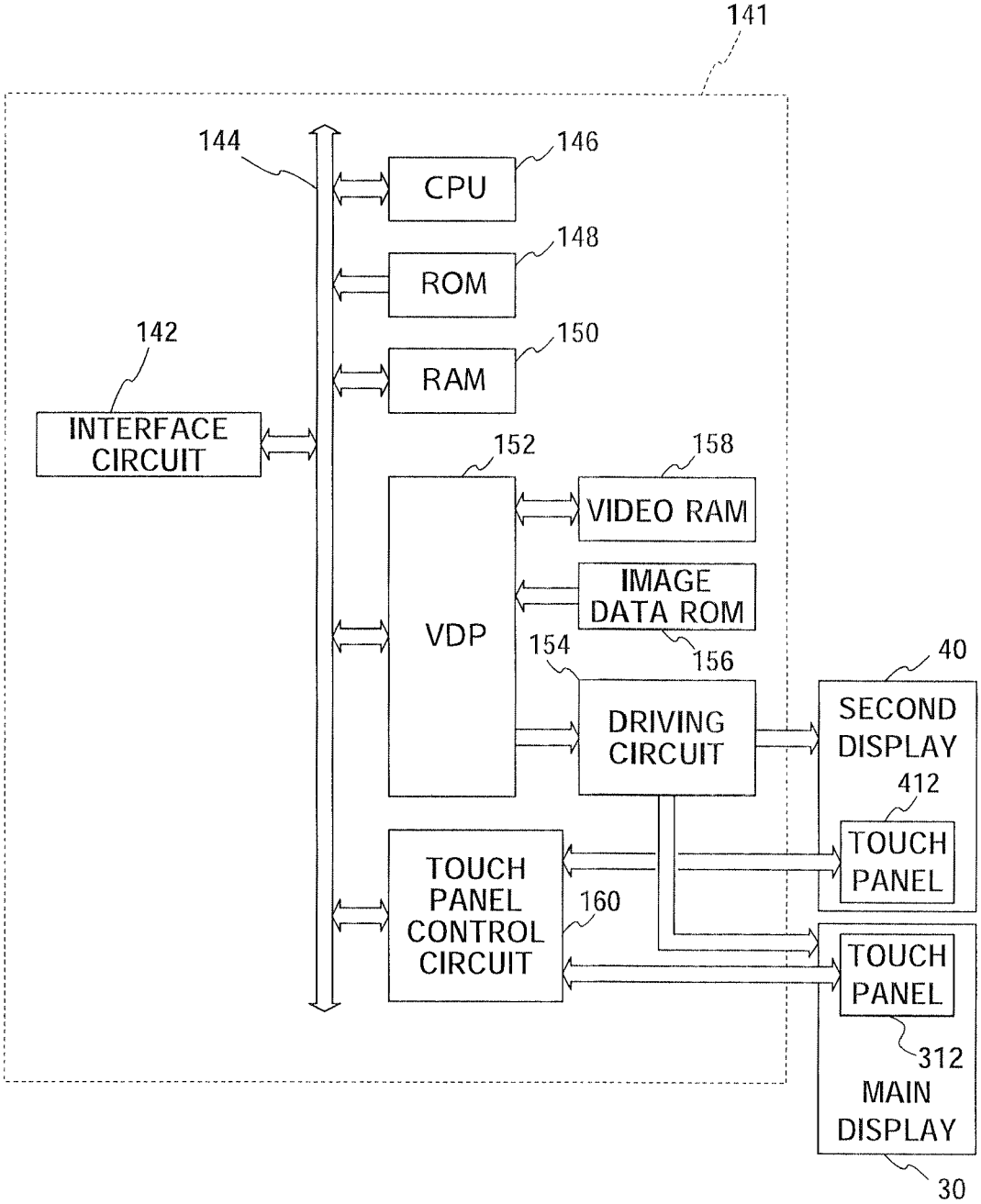
FIG. 11 is a block diagram of a controller of a gaming machine according to a second embodiment.

FIG. 11 is a block diagram showing the electrical configuration of the display/input controller 141 of the gaming machine according to the present embodiment. In a gaming machine of the present embodiment, a touch panel 312 is provided on the surface of the main display 30, a touch panel 412 is provided on the surface of the second display 40, a driving circuit 218 is connected to the main display 30 and the second display 40, and a touch panel control circuit 160 is connected to the touch panels 312 and 412.

Figure 12:
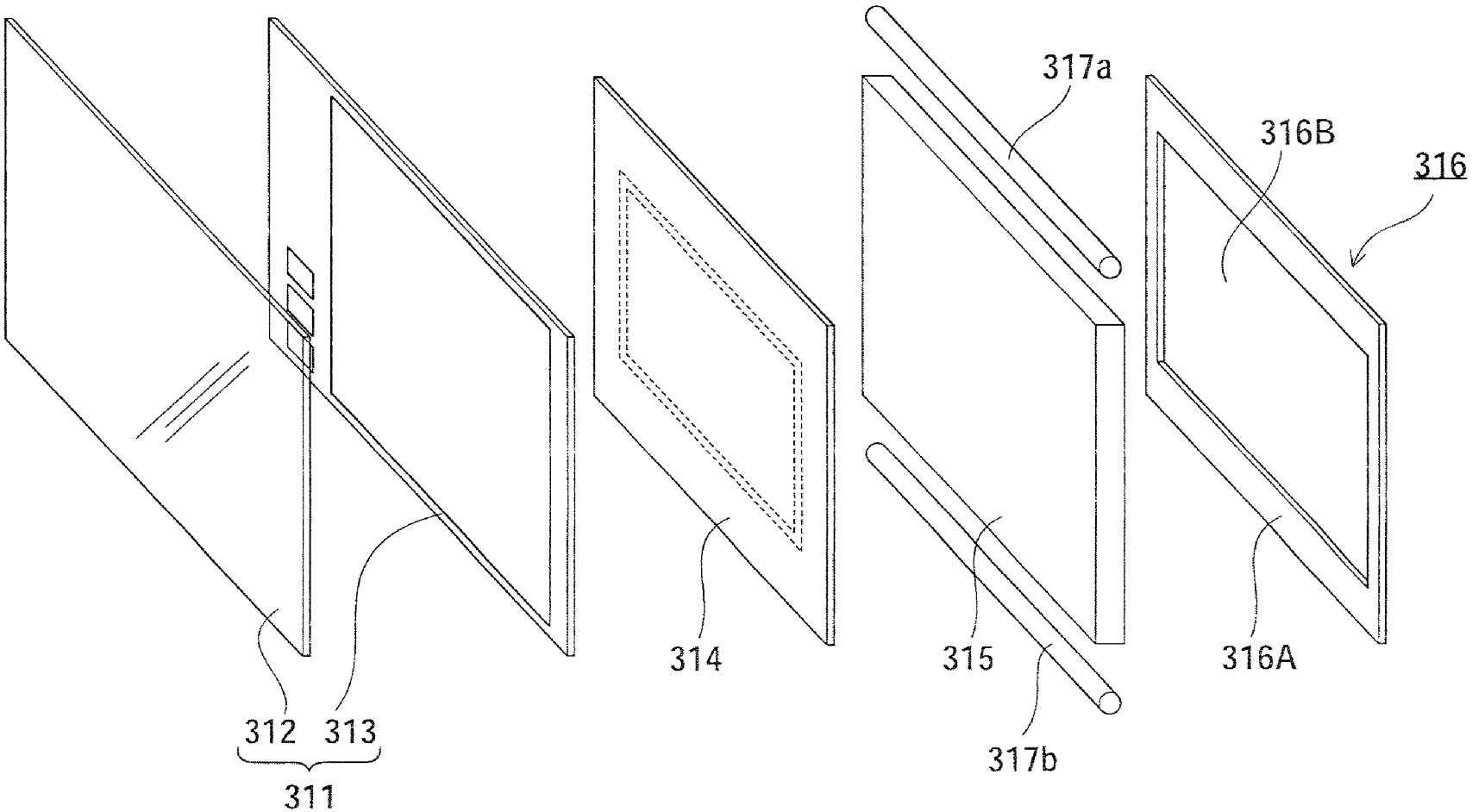
FIG. 12 is a partial exploded view showing the composition of a part of the main display shown in FIG. 11.

FIG. 12 is a partial exploded view showing the composition of a part of the main display 30. The main display 30 plays a role of the first display. The main display 30 thus includes a front panel 311 including the touch panel 312 and display board 313, a transparent liquid crystal panel 314, a light guide panel 315, a reflective film 316, a fluorescent lamp 317A and 317B that is a so-called while light source, and a table carrier package (TCP) including an IC for driving the transparent liquid crystal panel. The TCP is constituted of a flexible substrate (not shown) that is connected to an end terminal of the transparent liquid crystal panel 314. The touch panel 312 is constituted of transparent members. The display board 313 is constituted of transparent members.

Figure 13:
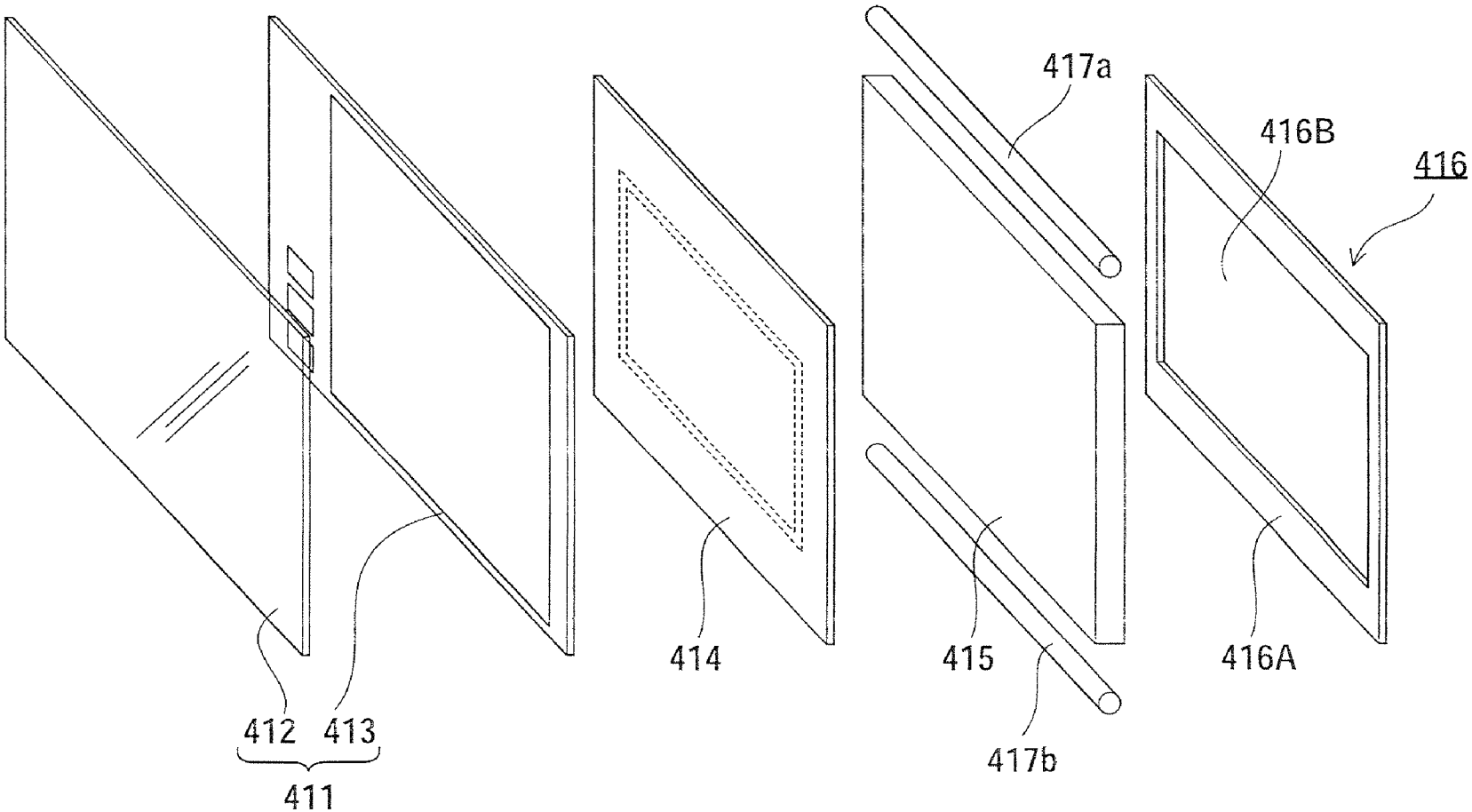
FIG. 13 is a partial exploded view showing the composition of a part of the second display shown in FIG. 11.

FIG. 13 is a partial exploded view showing the composition of a portion of the second display 40. The second display 40 plays a role of the second display. The second display 40 thus includes a front panel 411 including the touch panel 412 and display board 413, a transparent liquid crystal panel 414, a light guide panel 415, a reflective film 416, a fluorescent lamp 417A and 417B that is a so-called while light source, and a table carrier package (TCP) including an IC for driving the transparent liquid crystal panel. The TCP is constituted of a flexible substrate (not shown) that is connected to an end terminal of the transparent liquid crystal panel 414. The touch panel 412 is constituted of transparent members. The display board 413 is constituted of transparent members.

The second game processing of the present embodiment is hereinafter described with reference to FIG. 14.

First, in Step S201, the CPU 106 sets a value 5 for N, the N representing how many time the present routine can be executed. More specifically, the CPU 106 stores N=5, as an initial value for the present processing, in the RAM 110. The CPU 106 then advances to Step S202.

In Step S202, the CPU 106 determines whether the N is greater than 0 or not. More specifically, the CPU 106 reads the N stored in the RAM 110, and determines whether the N is greater than 0 or not. In a case where the N is determined to be greater than 0 (in the case of a YES determination in Step S202), the CPU 106 advances to Step S203. In a case where the N is determined to not be greater than 0 (in the case of a NO determination in Step S202), the CPU 106 terminates the present routine.

In Step S203, the CPU 106 displays a moving symbol on the main display 30. More specifically, the CPU 106 changes the image data and the like on the display window on the main display 30, which is stored in the video RAM 154, on the basis of the image data stored in the image data ROM 156, thus displaying a moving symbol. First, the CPU 106 displays the letters JP (JackPot) in one of the cells in the main display 30, to highlight the cell. Subsequently, the CPU 106 changes the letters JP into an isosceles triangle with a sharp edge, which is a moving symbol. The CPU 106 then advances to Step S204.

In Step S204, the CPU 106 displays a plurality of score symbols moving from a first side edge to a second side edge of the second display 40. More specifically, the CPU 106 changes the image data on the display window of the second display 40, which is stored in the video RAM 154 based upon the image data stored in the image data ROM 156, the symbol data of the score symbol written to the predetermined memory region in the RAM 110, and the like, to display the plurality of score symbols "MEGA", "MAJOR", "MINI", "500", and "300" that are moving between the first side edge and the second side edge of the rectangular second display 40 (see FIG. 10C). The CPU 106 then advances to Step S205. Scores are associated with the score symbol and the score information is also stored in the symbol data table in the RAM 110, such as 100000 points for the "MEGA" symbol, 50000 points for the MAJOR symbol, 1000 points for the "MINI" symbol, 500 points for the "500" symbol, and 300 points for the "300" symbol.

In Step S205, the CPU 106 determines whether an advancing instruction has been input or not. More specifically, the CPU 106 determines whether the spin repeat bet switch 24 has been pushed or not, and accordingly an operation signal has been input via the spin repeat switch 24 or not. In a case where the spin repeat bet switch 24 has been pushed, and accordingly, in a case of reception of an operation signal via the spin repeat switch 24 (in the case of a YES determination in Step S105), the CPU 106 determines that the advancing instruction has been input and advances to Step S206. Or the other hand, in a case where any of the input signal is not input in a predetermined period of time, the CPU 106 advances to Step S207.

In Step S206, the CPU 106 displays the moving symbols moving one cell toward the score symbols. In the present embodiment, the moving symbol moves one cell; however, the moving symbol can move any predetermined distance. More specifically, the CPU 106 changes the image data on the display window of the main display 30, which is stored in the video RAM 154 based upon the image data stored in the image data ROM 156 or the image data on the display window of the second display 40, the symbol data of the moving symbol written to the predetermined memory region in the RAM 110, and the like, to display the moving symbol moving toward the score symbols moving from a first side edge to a second side edge of the second display 40 (see FIG. 10C). The CPU 106 then advances to Step S207. After that; the moving symbol reaches the upper edge of the main display 30 and then moves from the lower edge of the second display, this step is repeated until the moving symbol reaches any score symbol or the upper edge of the second display 40.

In Step S207, the CPU 106 determines whether the free move instruction has been input. More specifically in a case where the touch panel 312 is pushed and accordingly a signal from the touch panel 312 is input while the moving symbol is moving in the main display 30, the CPU 106 determines that a free move instruction has been input, and advances to Step S208. In addition, in a case where the touch panel 412 is pushed and accordingly a signal from the touch panel 412 is input while the moving symbol is moving in the second display 40, the CPU 106 determines that a free move instruction is input and advances to Step S208. On the other hand, in a case where any of the input signals has not been input in a predetermined period of time, the CPU 106 advances to Step S209

In Step S208, the CPU 106 freely moves the moving symbol. "Freely moves the moving symbol" indicates that the CPU 106 moves the moving symbol in a different direction from the moving direction of the moving symbol. More specifically, the CPU 106 displays the moving symbol moving in a direction toward the portion pushed on the touch panel 312, e.g., moving one cell in a direction vertical to the moving direction of the score symbols, in response to a signal input from the touch panel 312, in a case in which the moving symbol is moving in the main display 30. To accomplish this processing, the CPU 106, in accordance with a signal that is input from the touch panel 312 changes the image data on the display window on the main display 30 stored in the video RAM 154, the symbol data of the moving symbol written to the predetermined memory region in the RAM 110, and the like, based upon the image data stored in the image data ROM 156.

Figure 15:
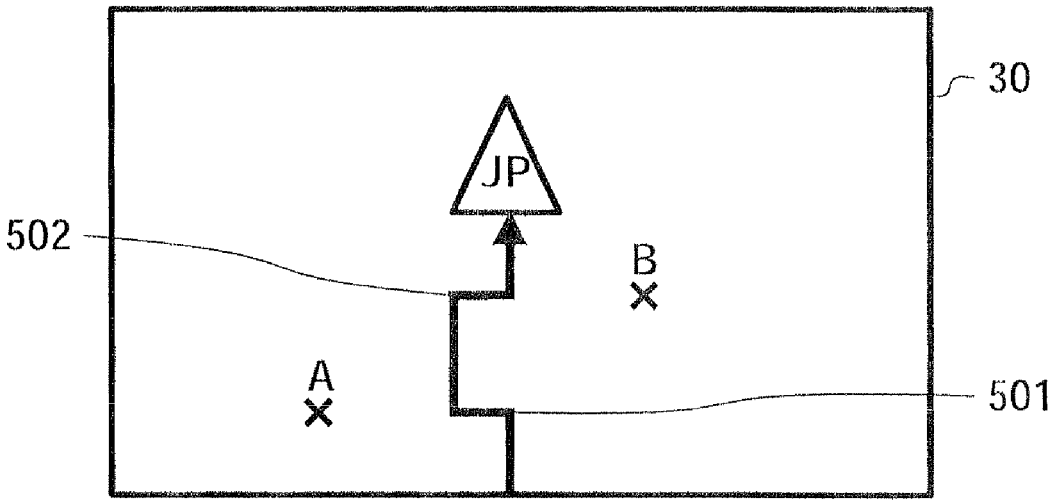
FIG. 15 is a diagram showing an example of a migration path of the moving symbol displayed on the main display.

For example, as shown in FIG. 15, in a case where a point A is pushed on the touch panel 312 constituting the main display 30 while the moving symbol is located at the point indicated by reference number 501 on the main display 30, the CPU 106 moves the moving symbol toward the point A by changing the image data on the display window of the main display 30 stored in the video RAM 154, the symbol data of the moving symbol written to the predetermined memory region in the RAM 110, and the like on the basis of the image data stored in the image data ROM 156, in accordance with the signal that is input from the touch panel 312. Similarly, in a case where a point B is pushed while the moving symbol is located at the point indicated by a reference number 502 on the main display 30, the moving direction of the moving symbol is moved theretoward. The range, speed, direction and the like of the biasing are not limited thereto and can be defined in accordance with a distance between the pushed position on the touch panel 312 and the position of the moving symbol, the duration of pushing operation on the touch panel 312, and the like.

Figure 16:
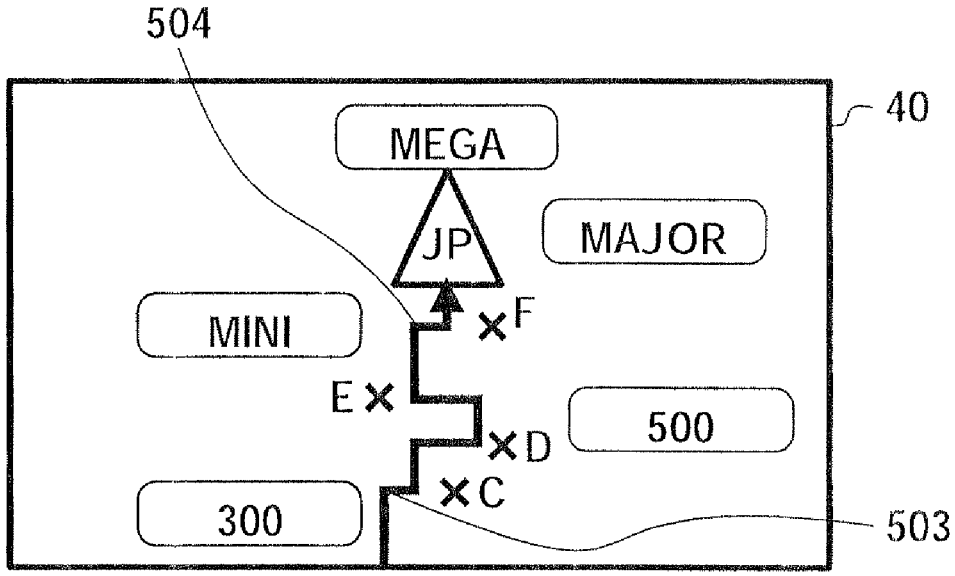
FIG. 16 is a diagram showing an example of a migration path of the moving symbol displayed on the second display.

For example, as shown in FIG. 16, in a case where a point C is pushed on the touch panel 412 constituting the second display 40 while the moving symbol is located in the point indicated by reference number 503 on the second display 40, the CPU 106 moves the moving symbol toward the point C by changing the image data on the display window of the second display 40 stored in the video RAM 154, the symbol data of the moving symbol written to the predetermined memory region in the RAM 110, and the like on the basis of the image data stored in the image data ROM 156, in accordance with the signal that is input from the touch panel 412. Similarly, in a case where a point F is pushed while the moving symbol is located in the point indicated by a reference number 504 on the second display 40, the moving direction of the moving symbol is moved theretoward. The range, speed, and the like of the biasing are not limited thereto and can be defined in accordance with a distance between the pushed position on the touch panel 412 and the position of the moving symbol, the duration of pushing operation on the touch panel 412, and the like. The CPU 106 then advances to Step S209.

As described above, the present embodiment allows the moving symbol to be moved freely by the pushing operation on the touch panels 312 and 412, thus allowing the direction of the moving symbol to be adjusted in a case where the moving symbol moves in an undesirable direction. The direction can be adjusted also by pushing the points D and E.

In Step S209, the CPU 106 determines whether the moving symbol superimposes any score symbol. More specifically, the CPU 106 references the symbol data written to the predetermined memory region in the RAM 110 and determines whether the moving symbol superimposes any score symbol. In a case where the moving symbol is determined to superimpose any score symbol (in the case of a YES determination in Step S209) the CPU 106 advances to Step S210, and in a case where the moving symbol is determined not to superimpose any score symbol (in the case of a NO determination in Step S209), the CPU 106 advances to Step S211.

In Step S210, the CPU 106 provides an award in accordance with the score symbol being superimposed. More specifically, the CPU 106 references the symbol data stored in the predetermined memory region in the RAM 110, and pays out an award corresponding to the score associated with the score symbol being superimposed by the moving symbol. For example, the CPU 106 pays out 100000 points in a case where the moving symbol superimposes the "MEGA" symbol, as shown in FIG. 10D. Subsequently, the CPU 106 advances to Step S212.

In Step S211, the CPU 106 determines whether the moving symbol has reached the upper edge of the second display 40 or not. More specifically, the CPU 106 references the symbol data stored in the predetermined memory region in the RAM 110 and determines whether the moving symbol has reached the upper edge of the second display. In a case where the moving symbol is determined to have reached the upper edge (in the case of a YES determination in Step S211), the CPU 106 advances to Step S212, and in a case where the moving symbol is determined to not have reached the upper edge (in the case of a NO determination in Step S211), the CPU 106 advances to Step S205.

In Step S212, the CPU 106 subtracts 1 from N, which is stored in the RAM 110. The CPU 106 then advances to Step S202.

As described above, the gaming machine of the present embodiment can reflect substantially the player's intention on the behavior of the moving symbol used in the game by displaying the score symbols and a moving symbol on the display and further biasing the direction of the moving symbol in a direction different from the direction of the score signal, in accordance with the free move instruction from the player. Moreover, the present invention can provide improved entertainment properties by displaying the score symbols and a moving symbol in a second game with a higher payout rate, of coins and the like, than that of a so-called basic game.

Furthermore, a more unpredictable game can be provided than the first embodiment, by providing a touch panel and allowing the moving symbol to be freely moved in accordance with the pushed position and the pushed duration on the touch panel. Moreover, the present invention can provide improved entertainment properties by displaying the score symbols and a moving symbol in a second game with a higher payout rate, of coins and the like, than that of a so-called basic game. In addition, the moving symbol requires a repetitive operation of the input device by the player to reach any one of the score symbols; thus reflecting the player's intention directly to the game.

The moving symbol starts moving freely in response to a pushing operation of the touch panels 312 or 412 in the present embodiment; however, the present invention is not limited thereto and the moving symbol can move freely in response to a pushing operation of the bet switch 23, the start switch 25, the touch panel 412 and the like. The moving symbol is configured to start advancing in response to a pushing operation of the spin repeat bet switch 24; however, the present invention is not limited thereto and the moving symbol can start advancing in response to a pushing operation of the bet switch 23, the start switch 25, the touch panel 412 and the like.

What is claimed is:

1. A gaming machine comprising:

a first display and a rectangular second display for displaying images; an input device for accepting an input from a player; and a controller for executing processing of:

(a) determining whether a plurality of specific symbols are displayed on the first display in a specific pattern in a basic game or not;

(b) starting execution of a second game in a case where the plurality of specific symbols are determined to be displayed in the specific pattern;

(c) in the second game, displaying a moving symbol on the first display;

(d) displaying a plurality of score symbols moving from a first side edge to a second side edge of the second display, where the first side edge and second side edge are facing each other and the score symbols are associated with obtained scores;

(e) upon accepting each input from the input device, displaying the moving symbol moving a distance in a direction intersectional to a moving direction of the score symbols displayed on the second display;

(f) determining whether the moving symbol superimposes any one of the plurality of score symbols or not; and (g) in a case where the moving symbol is determined to superimpose any one of the plurality of score symbols, providing an award corresponding to a score of the score symbol being superimposed.

2. The gaming machine according to claim 1, wherein, in the processing (e), the controller displays the moving symbol upon accepting each input from the input device, the moving symbol running through the first display and moving over the second display in the direction intersectional to the moving direction of the score symbols displayed on the second display.

3. The gaming machine according to claim 1, wherein, in the processing (b), the controller starts execution of the second game in a case where at least a number of the specific symbols are displayed on the first display.

4. The gaming machine according to claim 1, wherein the second display is disposed above the first display.

5. The gaming machine according to claim 1, wherein the input device is a touch panel for accepting an input by a pushing operation by a player, the touch panel is disposed so as to transparently cover the first display, wherein the controller, in the processing (e), displays the moving symbols moving in accordance with a position touched on the touch panel and a period for which the touch panel is touched.

6. A gaming machine comprising:

a first display and a rectangular second display for displaying images; an input device for accepting an input from a player; and a controller for executing processing of:

(a) determining whether a plurality of specific symbols are displayed on the first display in a specific pattern in a basic game or not;

(b) starting execution of a second game in a case where at least a number of the specific symbols are determined to be displayed on the first display;

(c) in the second game, displaying a moving symbol on the first display;

(d) displaying a plurality of score symbols moving from a first edge to a second side edge of the second display, where the first side edge and the second side edge are facing each other and the score symbols are associated with obtained scores;

(e) upon accepting each input from the input device, displaying the moving symbol moving a distance in a direction intersectional to a moving direction of the score symbols displayed on the second display;

(f) determining whether the moving symbol superimposes any one of the plurality of score symbols or not; and (g) in a case where the moving symbol is determined to superimpose any one of the plurality of score symbols, providing an award corresponding to a score of the score symbol being superimposed.

7. A gaming machine comprising: a first display and a rectangular second display for displaying images; an input device for accepting an input from a player; and a controller for executing processing of:

(a) determining whether a plurality of specific symbols are displayed on the first display in a specific pattern in a basic game or not;

(b) starting execution of a second game in a case where at least a number of the specific symbols are determined to be displayed on the first display;

(c) in the second game, displaying a moving symbol on the first display;

(d) displaying a plurality of score symbols moving from a first side edge to a second side edge of the second display, where the first side edge and second side edge are facing each other and the score symbols are associated with obtained scores;

(e) displaying the moving symbol upon accepting each input from the input device, the moving symbol running through the first display and moving a distance over to the second display in a direction intersectional to a moving direction of the score symbols displayed on the second display;

(f) determining whether the moving symbol superimposes any one of the plurality of score symbols or not; and (g) in a case where the moving symbol is determined to superimpose any one of the plurality of score symbols providing an award corresponding to a score of the score symbol being superimposed.

* * * * *